United States Patent [19]

Beasley et al.

[11] 4,170,928

[45] Oct. 16, 1979

[54] APPARATUS FOR FABRICATING AND ASSEMBLING MULTI-CELL PARTITIONS

[75] Inventors: Marion W. Beasley, Bishopville; Harlan L. Carroll, Cassatt; Hurley R. Brooking, Hartsville, all of S.C.

[73] Assignee: Sonoco Products Company, Hartsville, S.C.

[21] Appl. No.: 855,809

[22] Filed: Nov. 29, 1977

[51] Int. Cl.[2] ..... B31D 3/04

[52] U.S. Cl. ..... 93/37 R; 93/58 R

[58] Field of Search ..... 93/37 R, 37 EC, 37 SP, 93/38, 36 R, 58 R

[56] References Cited

U.S. PATENT DOCUMENTS

| | | | |
|---|---|---|---|
| 592,172 | 11/1894 | Herr | 251/258 |
| 609,684 | 8/1898 | Lahr | 93/38 |
| 1,996,812 | 4/1935 | Jensen et al. | 93/37 R |
| 2,092,760 | 9/1937 | Jensen et al. | 93/37 R |
| 2,283,492 | 5/1942 | Delegard | 93/38 |
| 2,494,437 | 1/1950 | George et al. | 93/37 R |
| 2,723,602 | 11/1955 | Schroeder | 93/37 R |
| 2,767,625 | 10/1956 | Schroeder | 93/37 R |
| 2,802,406 | 8/1957 | Lindsay | 93/37 R |
| 3,133,481 | 5/1964 | McCormick et al. | 93/37 R |
| 3,646,857 | 3/1972 | McDougal | 93/37 R |
| 3,685,401 | 8/1972 | Peters | 93/37 R |
| 3,690,225 | 9/1972 | Monaco et al. | 93/37 R |
| 3,809,593 | 5/1974 | Burke et al. | 156/257 |
| 3,998,136 | 12/1976 | Peters, Jr. | 93/37 R |

*Primary Examiner*—James F. Coan

*Attorney, Agent, or Firm*—Bell, Seltzer, Park & Gibson

[57] ABSTRACT

Apparatus for successively fabricating and assembling in a collapsed condition multicell partitions having a plurality of intermeshing slotted transverse and longitudinal strips for use in cartons, crates and the like.

21 Claims, 24 Drawing Figures

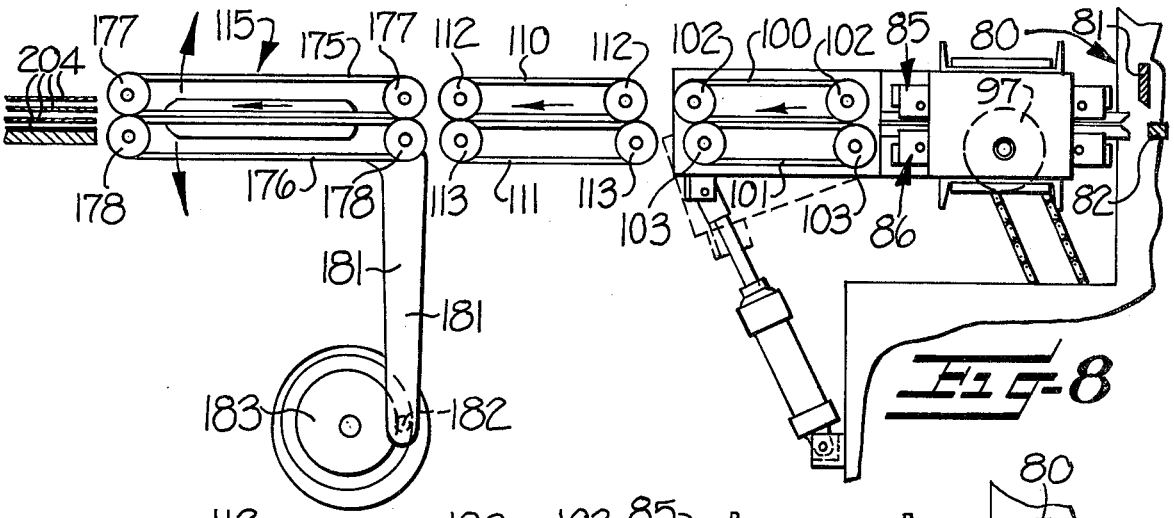
Fig-8
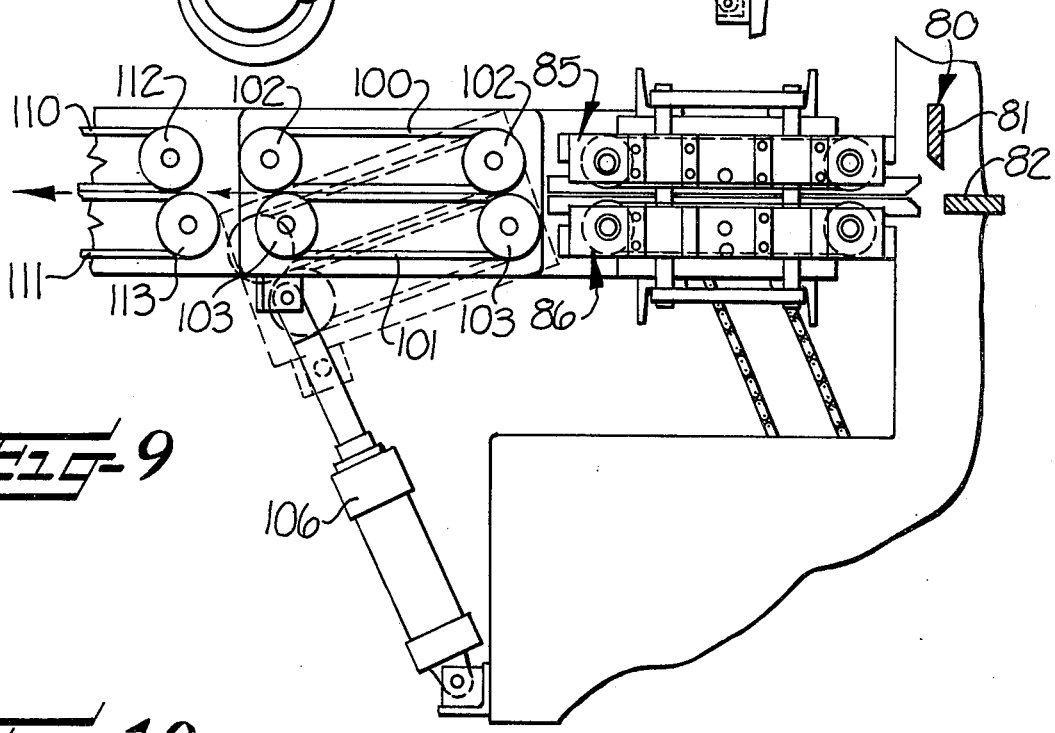
Fig-9
Fig-10
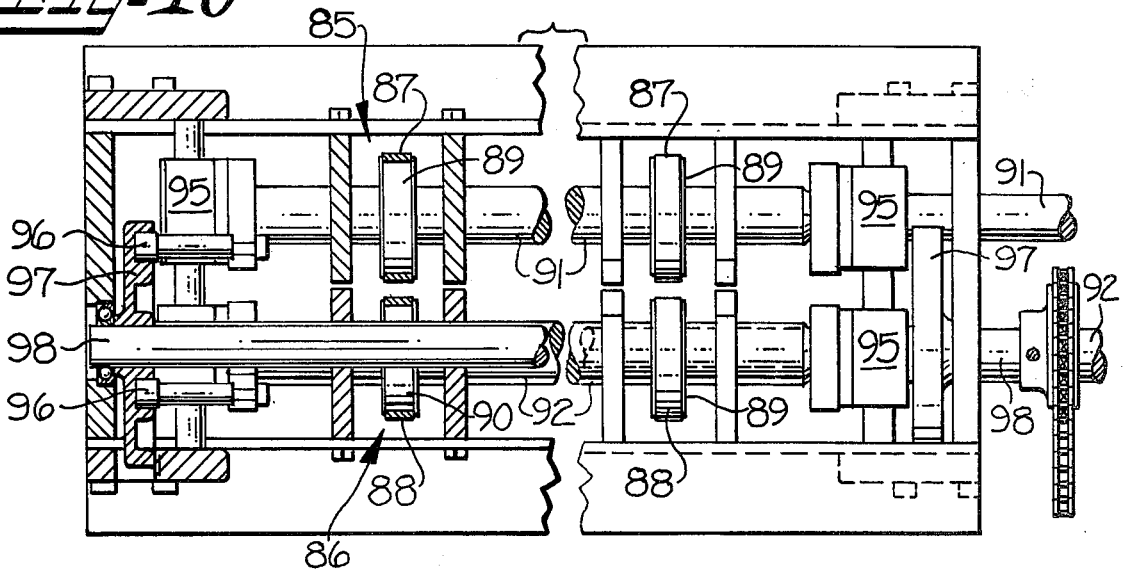

APPARATUS FOR FABRICATING AND ASSEMBLING MULTI-CELL PARTITIONS

This invention relates to an apparatus for successively fabricating and assembling in a collapsed condition multi-cell partitions having a plurality of intermeshing slotted transverse and longitudinal partition strips for use in cartons, crates and the like in which the apparatus is characterized by an improved construction providing for fabrication and assembly of varying sizes and types of partitions at desired speeds for commercial operation.

BACKGROUND OF THE INVENTION

Multi-cell partitions, sometimes known as "inner pack assemblies" are conventionally utilized in cartons, boxes, crates and other containers for separating articles packed therein to prevent breakage or damage to articles caused by contact between the articles. These multi-cell partitions are conventionally constructed of paper board, such as chip board, fiber board and the like, and include a plurality of intermeshing slotted transverse and longitudinal partition strips which must be separately fabricated and assembled in desired intermeshing relationship at their slotted edges for providing desired multi-cell partitions. These partitions are also constructed in varying numbers of cells, such as twelve, twenty-four, etc., and are of varying heights, lengths and widths for use in varying size cartons, boxes, crates and the like.

Heretofore, machines have been proposed for fabricating and/or assembling multi-cell partitions. Most of these previously proposed machines were constructed for assembling the intermeshing longitudinal and transverse partition strips into a partition in the open condition thereof as subsequently used in a carton, box, crate or the like. For the most part, these machines successively assembled partitions by an intermittent operation rather than providing for substantially continuous flow of the strips during assembly. Thus, while these machines may satisfactorily fabricate and assemble multi-cell partitions, they lack the speed and/or versatility necessary for satisfactory commercial operation, e.g. desired speed for producing a desired number of partitions in a given time for commercially profitable operation and desired flexibility and adjustment of the machine for providing varying cell types and sizes of partitions.

Examples of such machines for fabricating and assembling or assembling alone multi-cell partitions in the open condition may be seen from the following prior are patents considered with respect to this invention:

| U.S. Pat. No. | Inventor | Issue Date |
|---|---|---|
| 592,172 | Herr | November 13, 1894 |
| 609,684 | Lahr | August 23, 1898 |
| 1,996,812 | Jensen et al | April 9, 1935 |
| 2,092,760 | Jensen et al | September 14, 1937 |
| 2,283,492 | Delegard | May 19, 1942 |
| 2,494,437 | George et al | January 10, 1950 |
| 2,723,602 | Schroeder | November 15, 1955 |
| 2,767,625 | Schroeder | October 23, 1956 |
| 3,133,481 | McCormick et al | May 19, 1964 |
| 3,685,401 | Peters | August 22, 1972 |
| 3,690,225 | Monaco et al | September 12, 1972 |
| 3,809,593 | Burke et al | May 7, 1974 |

Another approach to assembling multi-cell partitions having slotted transverse and longitudinal partition strips is to assemble the partitions in a collapsed condition in which condition they are usually stored and shipped, capable of being erected to an open condition for use in cartons, boxes, crates and the like. Examples of such machines for assembling multi-cell partitions in the collapsed condition may be seen in the following patents:

| U.S. Pat. No. | Inventor | Issue Date |
|---|---|---|
| 3,646,857 | McDougal | March 7, 1972 |
| 3,998,136 | Peters | December 21, 1976 |

The apparatus of the above-listed McDougal U.S. Pat. No. 3,646,857 provides for intermittent movement of the longitudinal and transverse partition strips during assembly thereof and, accordingly, lacks the speed necessary for profitable commercial operation. Moreover, the apparatus of this McDougal patent does not provide for adjustment thereof to assemble varying cell types and sizes of partitions.

The above-listed Peters U.S. Pat. No. 3,998,136 provides for continuous, rather than intermittent, assembly of multi-cell partition strips in the collapsed condition. However, while the machine of this patent may provide satisfactory commercial speeds, the machine has not yet been commercialized and it is not known whether such machine will in fact operate at commercially desired speeds during its continuous operation for assembling multi-cell partitions in the collapsed condition. Notwithstanding, this latest proposed machine does not include adjustment mechanisms therein nor other features which would provide for fabrication and assembly of multi-cell partitions in the collapsed condition of varying cell types and sizes at commercially desired speeds of operation.

In order to overcome problems presented by the above described prior apparatuses of the previous patents listed above, employees of the assignee of the present invention, designed an improved apparatus for successively fabricating and assembling multi-cell partitions in the collapsed condition thereof which provided the desired speeds of operation and provided the desired adjustments for fabrication and assembly of multi-cell partitions of varying cell types and sizes. This improved apparatus is set forth in assignee's copending applications, Ser. Nos. 855,711, 855,622 and 855,713.

As will be noted by reference to assignee's aforementioned copending applications, the improved machine of these applications was designed for continuous, rather than intermittent, fabrication of both the transverse and longitudinal partition strips in order to provide sufficient quantities of such longitudinal and transverse strips to the assembling mechanism of the machine for assembly of the partitions in the collapsed condition at the speeds desirable for satisfactory commercial operation. In order to accomplish the continuous fabrication of both the transverse and longitudinal partition strips, rather than intermittent, the provision of a top and bottom locking tab and slot at the location of each cut slot in the individual longitudinal and transverse partition strips was eliminated.

However, it has now been determined that such top and bottom locking tabs and slots are sometimes desirable in such multi-cell partitions so as to prevent the partition strips from becoming unassembled from the partition. Accordingly, the continuous partition strip fabricating mechanisms of the machine of assignee's aforesaid copending applications are not desirable for fabricating longitudinal and transverse partition strips having such top and bottom locking tabs and slots thereon.

The above-listed Peters U.S. Pat. No. 3,685,401 discloses transverse and longitudinal partition strip fabricating mechanisms in a machine for fabricating and assembling multi-cell partitions in the open condition thereof in which the fabricated transverse and longitudinal strips include top and bottom locking tabs and slots, as shown in FIGS. 3 and 4 of the drawings of this Peters patent. However, the partition strip fabricating mechanisms of this Peters patent are intermittently operated and, therefore, would not provide a sufficient number of partition strips, particularly transverse partition strips where more are utilized than longitudinal partition strips in a given partition, for desired high-speed assembly of partitions in the collapsed condition by an assembling mechanism of the type disclosed in assignee's above-listed copending applications.

OBJECTS AND SUMMARY OF THE INVENTION

Accordingly, it is the object of this invention to provide an improved apparatus for successively fabricating and assembling in a collapsed condition multi-cell partitions having a plurality of intermeshing slotted transverse and longitudinal strips for use in cartons, crates and the like and which overcomes the problems presented by the above-described prior apparatuses.

It has been found by this invention that the above object may be accomplished by providing such an apparatus, which utilizes generally longitudinal and transverse partition strip fabricating mechanisms, of the general type disclosed in the Peters U.S. Pat. No. 3,685,401, which are arranged and modified in a unique and novel manner and combined with the assembling mechanism of assignee's above-mentioned copending applications which provide the flexibility necessary for high-speed assembly of partitions in the collapsed condition with adjustment features for handling and assembling varying sizes and types of partitions.

The apparatus of this invention comprises, generally the following.

Separate adjustable means are provided for fabricating elongate transverse and longitudinal partition strips from a continuous length of material, of a width desirable for the length of the strips, into individual strips of adjustable desired height having a desired adjustable number of spaced-apart slots in each extending inwardly a desired adjustable distance from the leading edge thereof to define a desired number of flaps on the leading end and for feeding such strips in a generally horizontally-extending linear path of travel.

The separate means for fabricating transverse partition strips comprises, in accordance with this invention, two of the fabricating means positioned for feeding the respective cut and slotted transverse strips in generally superimposed horizontally-extending linear paths of travel, and conveyor means of generally sideways Y-shaped configuration for receiving the fabricated partition strips from their superimposed paths of travel and for alternately merging the fabricated transverse partition strips into a single linear path of travel. The separate means for fabricating longitudinal partition strips comprises a single one of the fabricating means positioned for feeding the respective cut and slotted longitudinal partition strips in the generally horizontal linear path of travel in an opposing direction to the feed of the transverse partition strips.

Partition assembling means successively receives the leading cut and slotted edges of the transverse and longitudinal partition strips on respective opposite sides, successively positions strips of one of the series of fabricated transverse and longitudinal strips with successive flaps of each in vertically-staggered and spaced positions, successively positions strips of the other series of fabricated transverse and longitudinal strips in successive vertically-staggered and spaced relationship with all of the flaps of each strip in one vertical plane, conveys the thus positioned strips in a longitudinal direction generally transversely of the path of travel thereof through the fabricating means at a converging predetermined angle while separating a predetermined number of the strips into opposing groups of longitudinally-staggered strips and aligning the slots of the strips of opposing groups so that the opposing groups of strips will converge and intermesh as they are fed in the longitudinal path of travel for assembling the partitions in a collapsed condition.

The above assembling means preferably includes an elongate horizontally-extending guide means defining a plurality of longitudinally and horizontally-extending spaced parallel grooved trackways in respective opposite sides thereof for respectively receiving the leading slotted edges of the transverse and longitudinal partition strips therein at a receiving end thereof. The trackways correspond in number and position to the desired intermeshing relationship of the longitudinal and transverse partition strips when assembled into a partition in collapsed intermeshing relationship. Elongate cam means are movably positioned interiorly within certain of the trackways of the guide means so that the grooves in the trackways extend inwardly from the opposite outer edges of the guide means at a converging intermeshing predetermined angle from the end of the guide means receiving the partition strips to the other end thereof. Means continuously feed the transverse and longitudinal strips along the cam means and within the trackways from the receiving end to the remote end of the guide means for converging and intermeshing the slotted partition strips for assembling partitions in collapsed condition. Adjustment means are provided for the cam means for longitudinally moving the cam means within the guide means for varying the longitudinal position thereof and thus the depth of the trackway slots along the guide means for assembling varying sizes and types of partitions.

In a preferred form of apparatus in accordance with this invention, the transverse partition strip fabricating means comprises two pairs of the superimposed fabricating means in which each pair is positioned side-by-side on one side of the assembling means. In this embodiment, the longitudinal partition strip fabricating means comprise two fabricating means positioned side-by-side on the other side of the assembling means. The partition assembling means comprises two longitudinally-extending parallel superimposed assembling means for respectively receiving and assembling longitudinal and transverse partition strips from one of the two pairs of transverse partition strip fabricating means and from one of the two longitudinal partition strip fabricating means so as to assemble partitions in a generally "piggy-back" relationship.

Thus, the apparatus of this invention provides an improved apparatus for successively fabricating and assembling multi-cell partitions having a plurality of intermeshing slotted transverse and longitudinal partition strips for use in cartons, crates and the like and which provides a unique arrangement of partition strip fabricating mechanisms for feeding a desired number of intermittently fabricated partition strips, particularly the transverse partition strips, to a continuously operating assembling mechanism for assembling the partition strips at high speed in the collapsed condition thereof and which is constructed for adjustability for assembling of varying sizes and cell types of partitions at desired speeds for commercial operation.

The novel devices of this improved apparatus have been broadly described above and their specific novel constructions will be described hereinafter in connection with a specific description of a preferred embodiment of this invention.

BRIEF DESCRIPTION OF THE DRAWINGS

Some of the objects of the invention having been stated, other objects will appear as the description proceeds, when taken in conjunction with the accompanying drawings, in which:

FIG. 4 is a perspective view of the twenty-four cell partition of FIG. 3 in the open condition thereof as utilized in a carton, crate or the like;

FIG. 8 is a partial side elevational view of a portion of one of the fabricating stations of the apparatus of this invention illustrating particularly intermittent feed conveyor mechanisms, a reject conveyor mechanism and other feeding and positioning mechanisms;

FIG. 9 is an enlarged, side elevational view with parts removed of a portion of the apparatus of FIG. 8;

FIG. 10 is a cross-sectional view taken through the intermittent feed conveyor mechanism illustrated in FIGS. 8 and 9;

DESCRIPTION OF PREFERRED EMBODIMENT

With the apparatus according to the present invention, multi-cell partitions P (see FIGS. 3-5), for use in cartons, crates, boxes and the like are produced from pliable sheet material M, such as paper chip board or fiber board, simultaneously and in substantially continuous succession along two generally parallel production lines, termed herein as primary and secondary production lines. The assembly stations A, A′ of the two generally parallel production lines are in superimposed relationship (see FIG. 1) for assembling partitions P in a generally "piggy-back" relationship. Each of the primary and secondary production lines also include respective transverse and longitudinal partition strip fabricating stations B, B′ and C, C′ positioned in generally side-by-side relationship (see FIG. 1).

Figure 1:
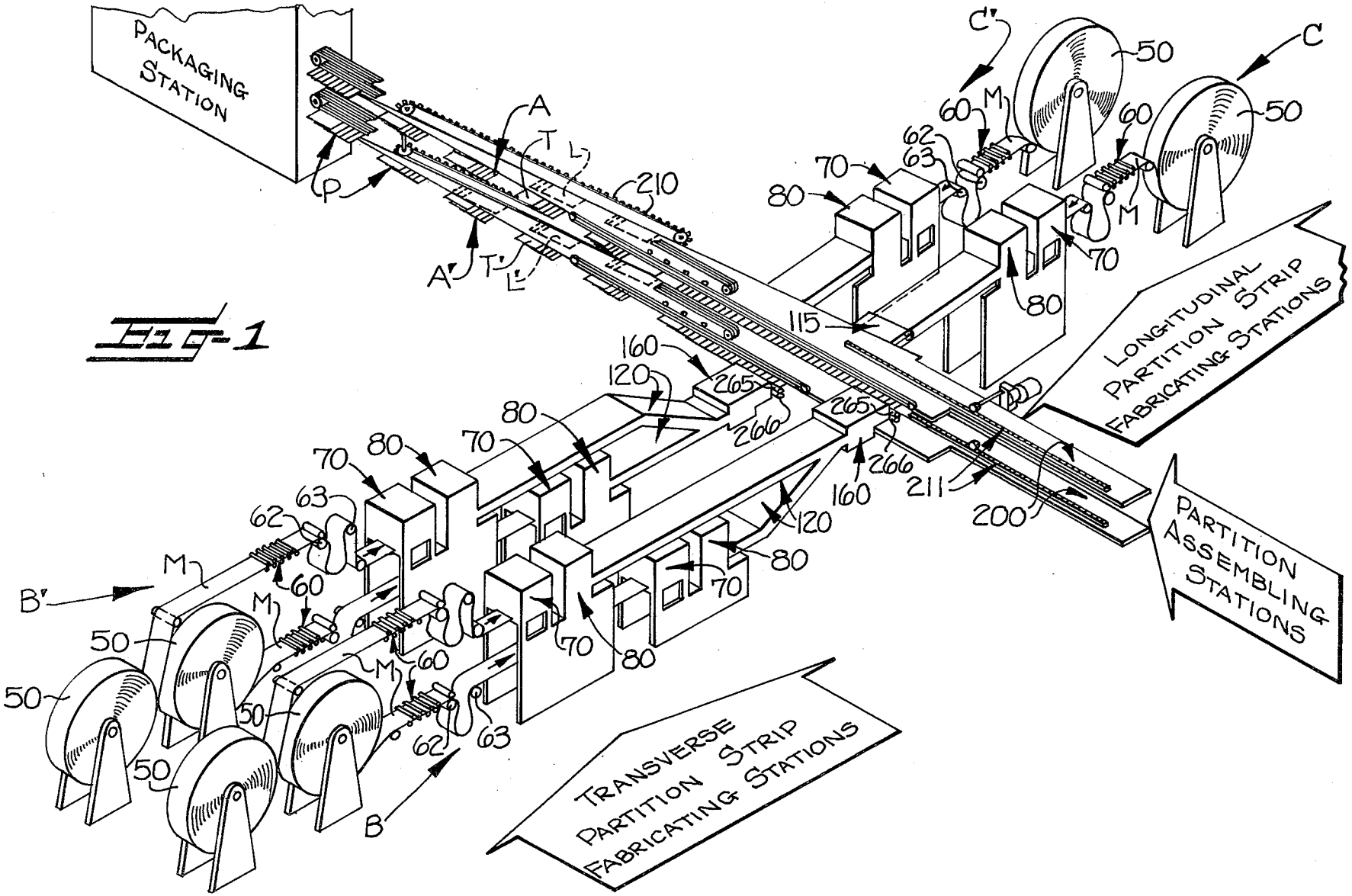
FIG. 1 is a perspective schematic and diagrammatic view illustrating apparatus for fabricating and assembling multi-cell partitions in a collapsed condition in accordance with the present invention.

As may be seen, particularly in FIG. 1, primary and secondary "transverse" partition strips T are fabricated at respective primary and secondary transverse partition strip fabricating stations B, B′ at one side of the primary and secondary partition assembling stations A, A′, and primary and secondary "longitudinal" partition strips L are formed at respective primary and secondary longitudinal partition strip fabricating stations C, C' at the other side of the partition assembling stations A, A'.

As set forth above, the transverse and longitudinal partition strip fabricating stations B, B' and C, C' are of the general type disclosed in the Peters U.S. Pat. No. 3,685,401, but which have been arranged and modified in a unique and novel manner to provide a desired number of intermittently fabricated transverse and longitudinal partition strips T and L to partition assembling stations A, A' which are of the general type disclosed in the copending applications Ser. Nos. 855,711, 855,622 and 855,713 of the assignee of the present invention which provides for continuously moving partition strips T and L along the assembling stations A, A' for assembling partitions P in a collapsed condition at desired commercial speeds of operation and which provides adjustment features (adjustable cams, etc.) for providing desired versatility for high-speed assembly of varying types and sizes of partitions.

Figure 4:
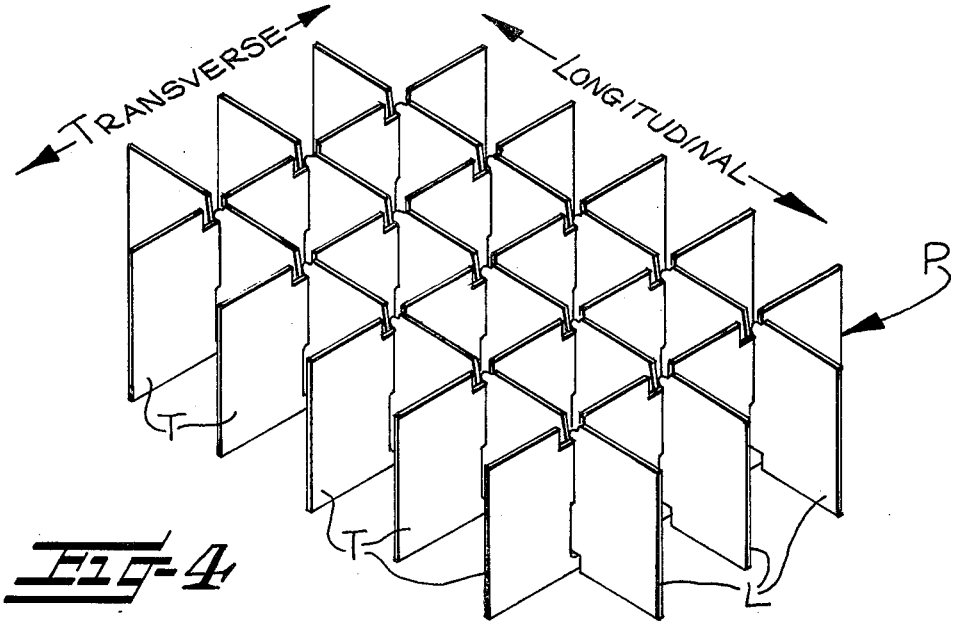
Figure 5:
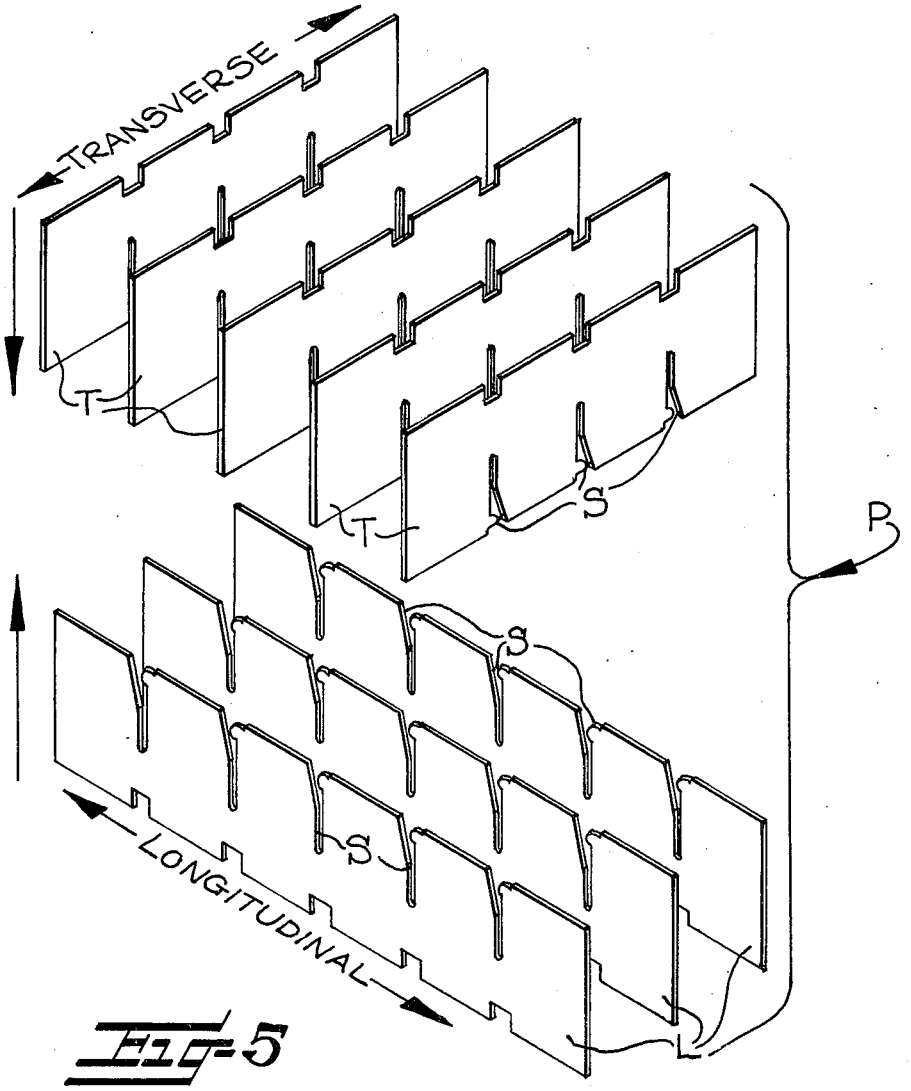
FIG. 5 is a perspective exploded view of the twenty-four cell partition of FIG. 4.

At the outset, it is to be understood that the terms "transverse" and "longitudinal", as applied to the partition strips T, L are used herein simply to distinguish those partition strips being formed at one side of the apparatus from those partition strips being formed at the other side of the apparatus and are not to be considered as imposing a limitation upon the partition strips within this disclosure. In fact, both types of partition strips are of elongate form, and although the transverse partition strips T, shown in the partition P of FIGS. 4 and 5, are shown as being of lesser length than the longitudinal partition strips L, since the apparatus of this invention is adjustable, it is contemplated that both types of strips may be of any desired length or height. Also, the transverse and longitudinal strips T, L may be fed to the partition assembling stations A, A' from those sides of the assembling stations opposite from the respective sides being described herein without departing from the present invention.

The terms "primary" and "secondary" are used herein to distinguish those partition strips and partitions being produced on one of the two primary and secondary production lines from those partition strips and partitions being produced and assembled on the other of the two production lines, it is noted that the primary partition strips are fed to and advanced along the primary assembling station on a level above that of the secondary partition strips in the particular illustrated embodiment of the apparatus of this invention.

I. Partition Strip Fabricating Stations

Each partition strip fabricating station B, B' and C, C' includes a sheet material supply 50 serving as a suitable source of pliable sheet material M, such as paper board, which may take the form of a roll carried by a suitable roll stand. The sheet material M may be of any desired width corresponding to the desired length of the partition strips T, L being fabricated. From these supplies 50, each respective sheet of material M is advanced through a feed control mechanism 60 which forms the respective sheet into a catenary loop suspended from and between spaced substantially parallel rollers or guides 62, 63. The size of the loop 61 in the sheet controls the operation of the respective feed control mechanism 60 by suitably detecting means embodied in suitable photoelectric devices (not shown), such feed control mechanisms being well known in various arts.

Figure 6:
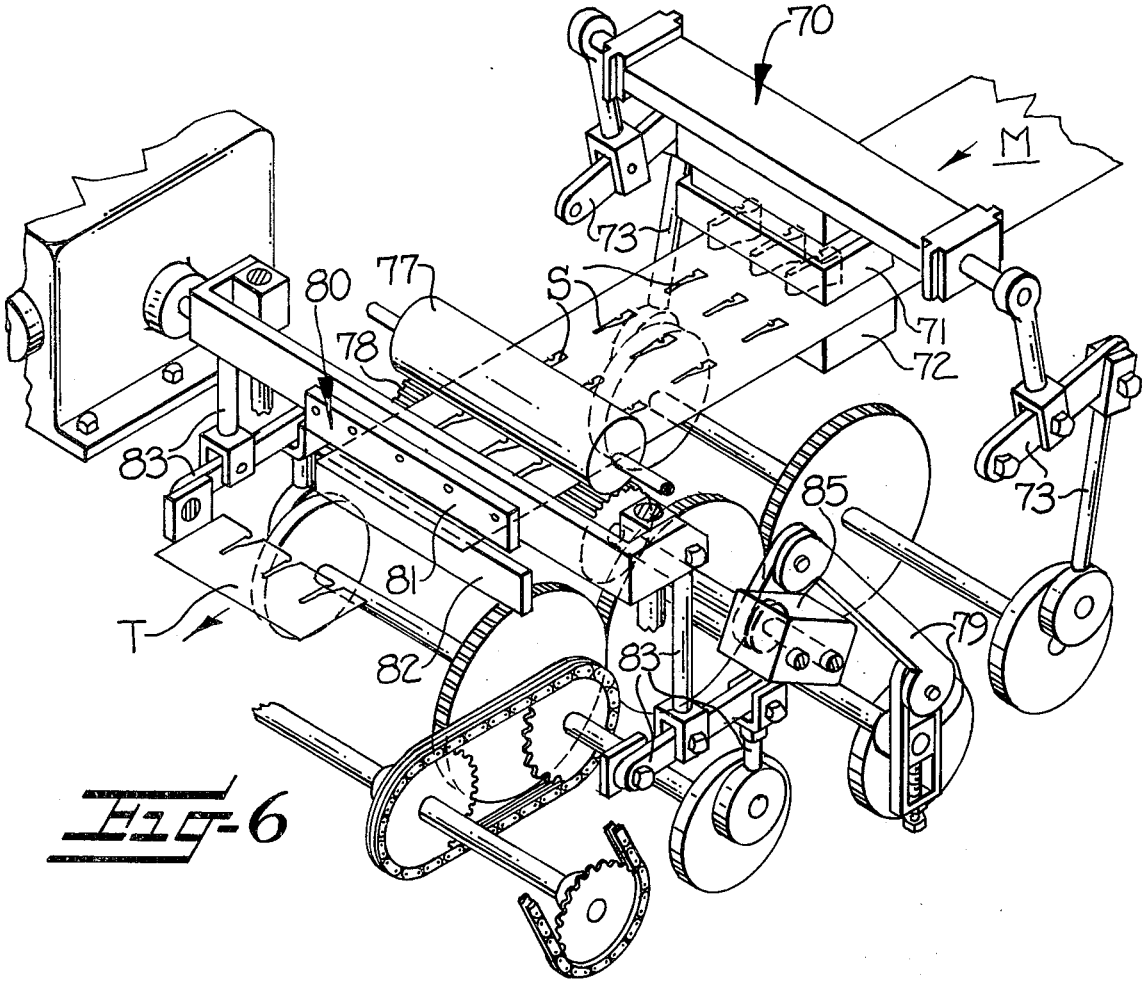
FIG. 6 is an enlarged perspective view of a portion of one of the fabricating stations of the apparatus of this invention illustrating particularly the slot cutting mechanism, feeding mechanism and strip cutting mechanism.

The sheet material M then passes through respective slot cutting mechanisms 70 (see particularly FIGS. 2, 6 and 7) for die cutting a desired adjustment number of spaced-apart slots S in rows extending transversely across the sheet material M and being longitudinally spaced apart. This slot cutting operation may be performed by a movably mounted die cutter 71 which is reciprocated up and down into contact with a stationary die 72 by a suitable crank arm drive mechanism 73 (as shown in FIG. 6). The die cutter 71 of this slot cutting mechanism is removable and replaceable so that a suitable die cutter 71 for cutting desired numbers and sizes of slots transversely across desired widths of the sheet material M may be placed in the slot cutting mechanism 70.

From the slot cutting mechanism 70, the sheet material M having the rows of slots S cut therein passes between intermittent feed devices in the form of a pair of feed rolls 77, 78 which are intermittently forwardly rotated by an adjustable crank arm drive mechanism 79 for being intermittently rotated forwardly a predetermined adjustable distance so that the sheet material M with rows of slots S cut therein is advanced past a strip cutting mechanism 80 a predetermined desired distance. The strip cutting mechanism 80 cuts the sheet of material into individual partition strips T or L along the bottom or rearward end of the slot S cut therein to define a desired number of flaps on the leading cut edge of each partition strip T or L. Each of the slots S is so configured that when the strip cutting mechanism 80 cuts the sheet of material into individual strips along the lower end of each of the slots, a locking tab and slot will be provided on respective leading and trailing edges of each of the cut strips T or L (as shown particularly in FIGS. 4 and 5). The strip cutting mechanism 80 comprises broadly a movable sheer type cutting blade 81 mounted for movement into and away from engagement with a stationary cutting blade 82. The movable blade 81 is moved by a suitable crank arm drive mechanism 83.

Figure 7:
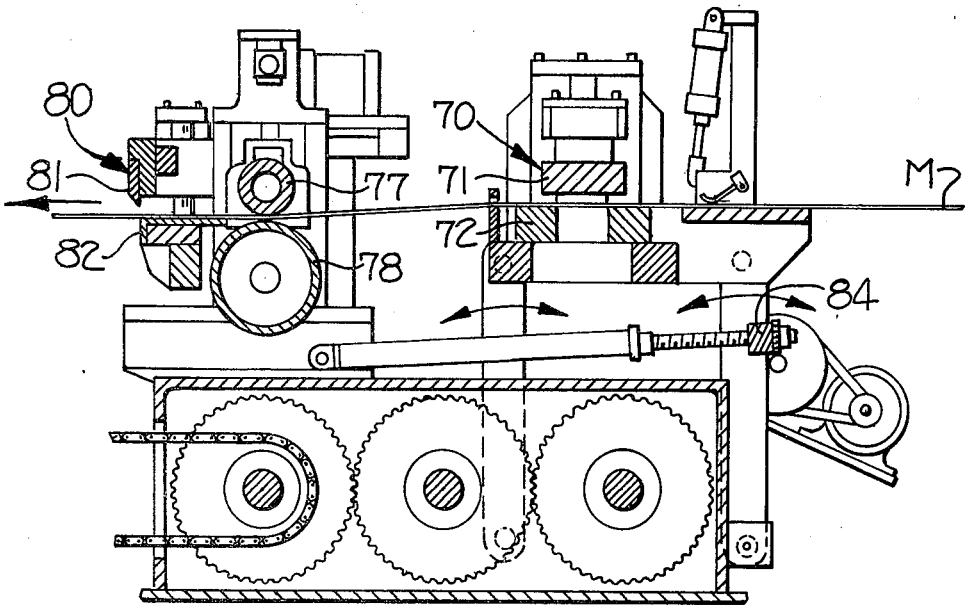
FIG. 7 is a sectional view taken through the mechanisms of FIG. 6.

The above described slot cutting mechanism 70, feed roll mechanism 77, 78 and strip cutting mechanism 80 are constructed generally in accordance with the above mentioned Peters U.S. Pat. No. 3,685,401 and include common interconnected drives (as shown in FIGS. 6 and 7) and adjustment mechanisms in the form of a worm gear device 84 for moving the slot cutting mechanism 70 and strip cutting mechanism 80 toward and away from each other and the feed roll mechanism 77, 78 includes a suitable adjustable intermittent differential drive 85 for adjustment thereof to feed a desired length of material past the strip cutting mechanism 80 so as to cut a desired height partition strip T or L. An exemplary adjustable intermittent drive mechanism is also described in the aforementioned Peters U.S. Pat. No. 3,685,401 and Peters U.S. Pat. No. 3,691,859 (Ser. No. 68,617) described therein. Accordingly, further details of these mechanisms will not be described herein and reference may be had to these Peters patents for a further description and understanding of these mechanisms which is incorporated herein by reference.

With the above, adjustable means are provided for fabricating elongate transverse and longitudinal partition strips T or L from a continuous length of material M of a width desirable for the length of the strips, into individual strips of adjustable desired height having a desired adjustable number of spaced-apart slots in each extending inwardly a desired adjustable distance from a leading edge thereof to define a desired number of flaps on the leading end of each of the strips and for feeding such strips in a generally horizontally-extending linear path of travel.

From the strip cutting mechanisms 80, the cut and slotted partition strips T or L are fed to rotatably driven superimposed conveyor means 85, 86 positioned adjacent the strip cutting mechanism 80 for receiving the leading end of the cut partition strip T or L and for intermittently feeding the strips forwardly in the generally horizontally-extending linear path of travel, as shown in FIGS. 8–10. These superimposed conveyor means 85, 86 may comprise a plurality of belts 87, 88 mounted for rotation on respective rolls or pulleys 89, 90 which are mounted on rotatably driven shafts 91, 92. The shafts 91, 92 are driven in synchronism with each other and with the other mechanisms of the partition strip fabricating stations B, B' and C, C' in any suitable manner (such as indicated schematically in FIGS. 11, 13 and 24).

Figure 11:
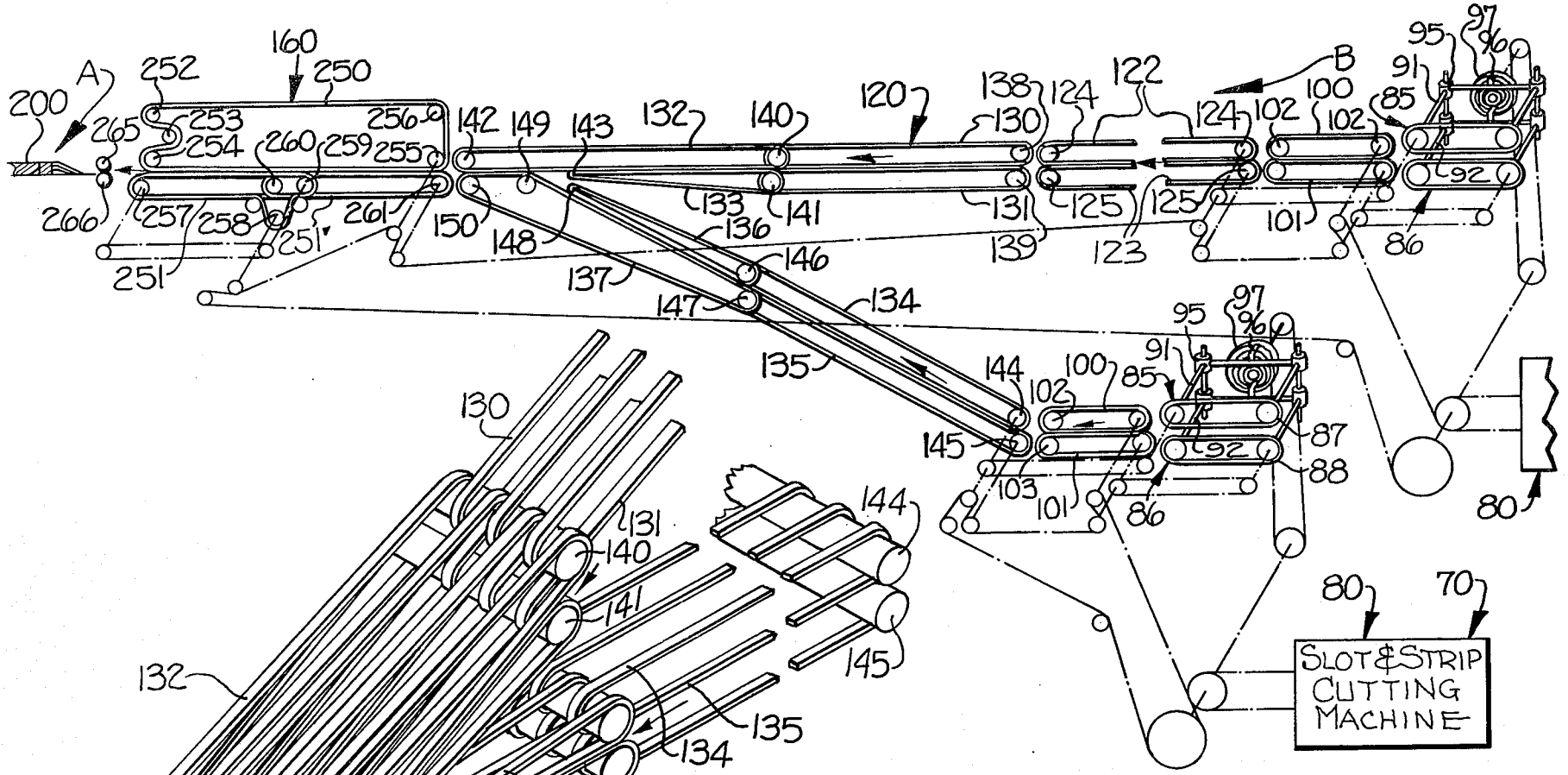
FIG. 11 is a schematic diagrammatic perspective view of feed conveyor mechanisms utilized in one of the transverse strip fabricating stations for feeding fabricated transverse partition strips to the upper partition assembling station of the apparatus of FIG. 1.
Figure 13:
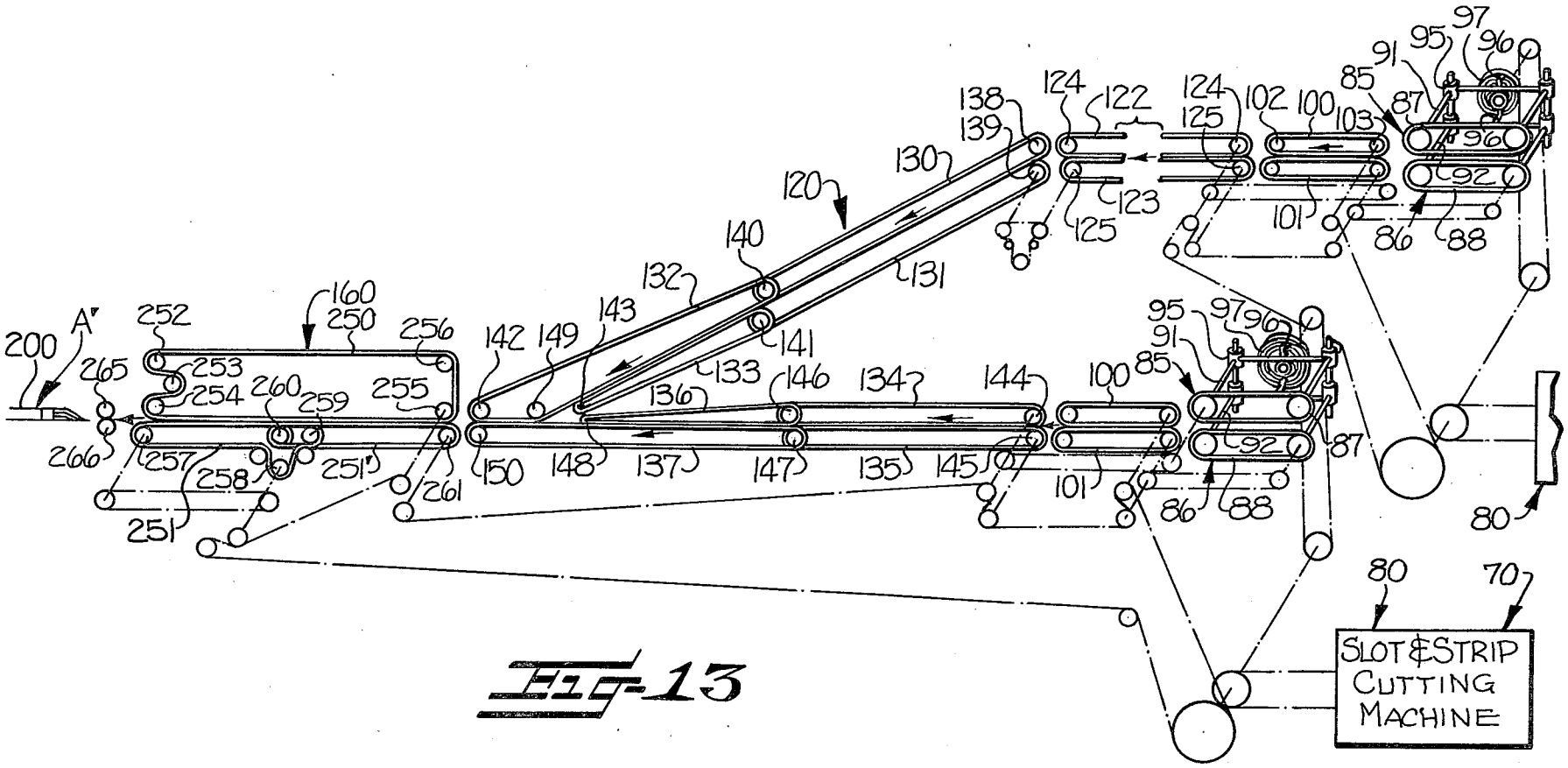
FIG. 13 is a view, like FIG. 11, illustrating feed conveyor mechanisms for the other transverse partition strip fabricating station for feeding fabricated partition strips to the lower partition assembling station of the apparatus of FIG. 1.

As shown particularly in FIG. 10 and schematically in FIGS. 11 and 13, the shafts 91, 92 of the conveyor means 85, 86 are mounted on vertical slide mechanisms 95 and are connected by cam followers 96 with cams 97 mounted on driven shaft 98 which is also driven in synchronism with the above-described mechanisms (as shown schematically in FIGS. 11 and 13) so that when the cams 97 rotate, the conveyor means 85, 86 and the belts 87, 88 thereof will be brought into and out of engagement with each other. This effects an intermittent forward feeding action of each of the cut partition strips T or L as the leading ends thereof are received between the nips of the conveyor means 85, 86 for desired intermittent forward feeding of the cut partition strips T or L with desired spacing therebetween in a generally horizontal linear path of travel (as shown schematically in FIG. 2).

From these intermittent feeding conveyor means 85, 86 the cut partition strips T or L are received and fed forwardly by two rotatably driven superimposed conveyor means 100, 101 (as shown in FIGS. 8 and 9). These superimposed conveyor means 100, 101 may also comprise a plurality of belts mounted on suitably driven rolls or pulleys 102, 103 which are also driven in synchronism with the other mechanisms of the partition strip fabricating stations (as shown schematically in FIGS. 11 and 13). These conveyor mechanisms 100 and 101 are carried by a suitable frame 105 which is pivotally mounted at its rear end and is connected with a suitable piston and cylinder mechanism 106 at its forward end which may be actuated to pivot the forward end of the conveyor means 100, 101 to a lower position out of the linear generaly horizontal path of travel for purposes of rejecting partition strips T or L in the event of improper fabrication or the like.

All of the transverse and longitudinal partition strip fabricating stations B, B' and C, C' include the above-described mechanisms. However, since a greater number of transverse partition strips T are required for feeding into the respective partition assembling stations A, A'(five transverse partition strips T and three longitudinal partition strips L are required for a twenty-four cell partition P as shown in FIGS. 4 and 5), provisions must be made for the fabrication and feed to the assembly stations A, A' of a greater number of transverse partition strips T than longitudinal partition strips L so as to provide an adequate supply of both partition strips T, L for continuous assembly of partitions P in the assembling stations A, A'.

Therefore, in accordance with this invention, each of the transverse partition strip fabricating stations B, B' comprise two of the above-described means for fabricating partition strips (as shown in FIG. 1). The two mechanisms, described above, for fabricating partition strips in the transverse fabricating stations B, B' are positioned generally in superimposed relationship (as shown in FIG. 1). On the other hand, the above-described means for fabricating longitudinal partition strips L in each of the longitudinal partition strip fabricating stations C, C' comprise only a single set of the above-described mechanisms for fabricating partition strips.

Referring first to the longitudinal partition strip fabricating station C, C' the cut and slotted partition strips L are fed from the reject conveyor mechanisms 100, 101 into the nip of an additional pair of superimposed conveyor mechanisms 110, 111 (see FIG. 8). These conveyor mechanisms 110, 111 may also comprise a plurality of belts mounted on suitably driven rolls or pulleys 112, 113 which are driven in synchronism with the above-described mechanisms in any suitable manner (such as shown schematically in FIG. 24). From the superimposed feed conveyor means 110, 111, each of the cut and slotted longitudinal partition strips L are fed into a positioning mechanism 115 for suitably positioning the longitudinal partition strips L in the partition assembling stations A, A'. This positioning mechanism 115 will be described below in connection with a description of the partition assembling stations.

Figures 2, 3:
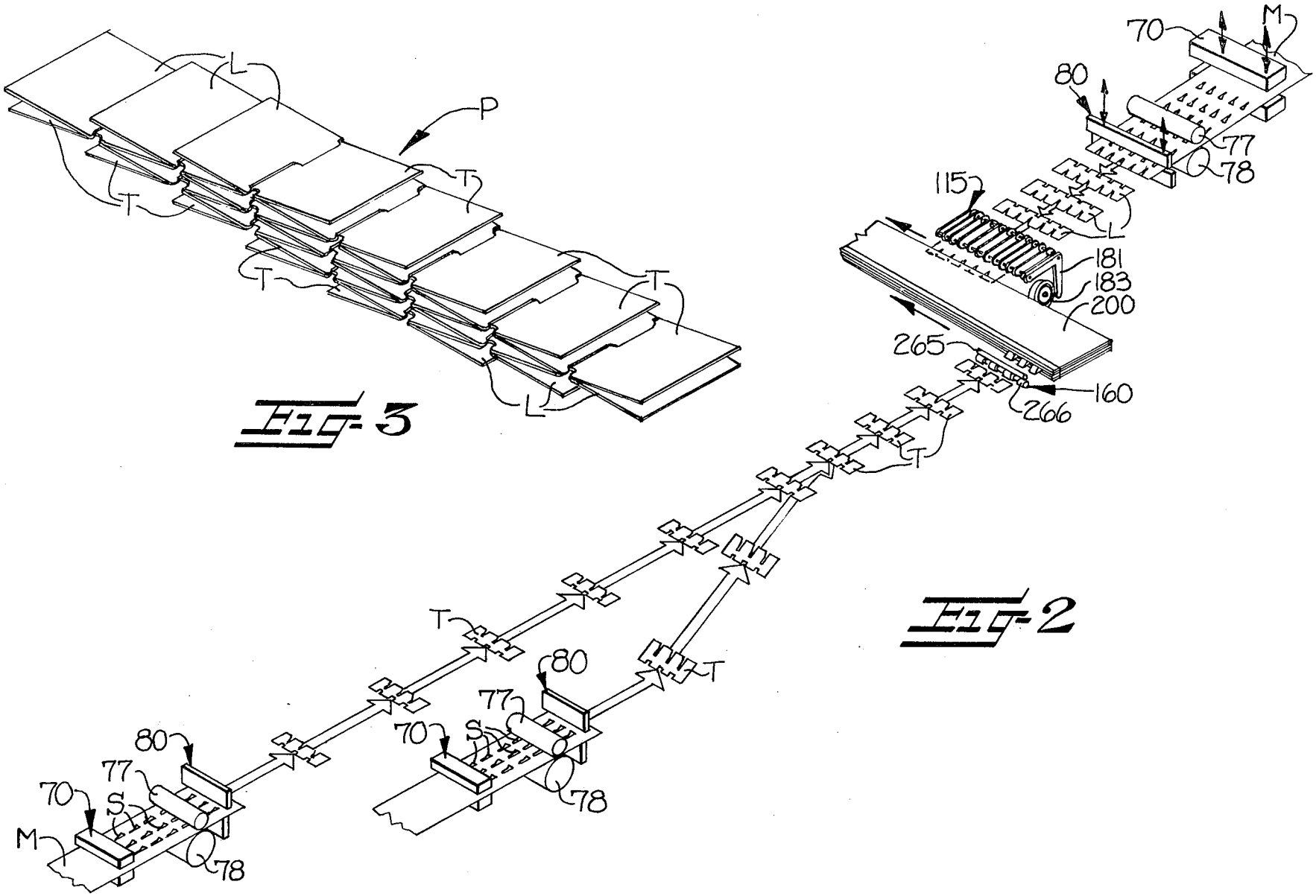
FIG. 2 is a schematic flow-type diagrammatic view illustrating particularly the flow of material and partition strips through the partition strip fabricating stations and into the assembling station of the apparatus of FIG. 1.
FIG. 3 is a perspective view of a typical twenty-four cell partition in the collapsed condition thereof after being fabricated and assembled by the apparatus of this invention.
Figure 12:
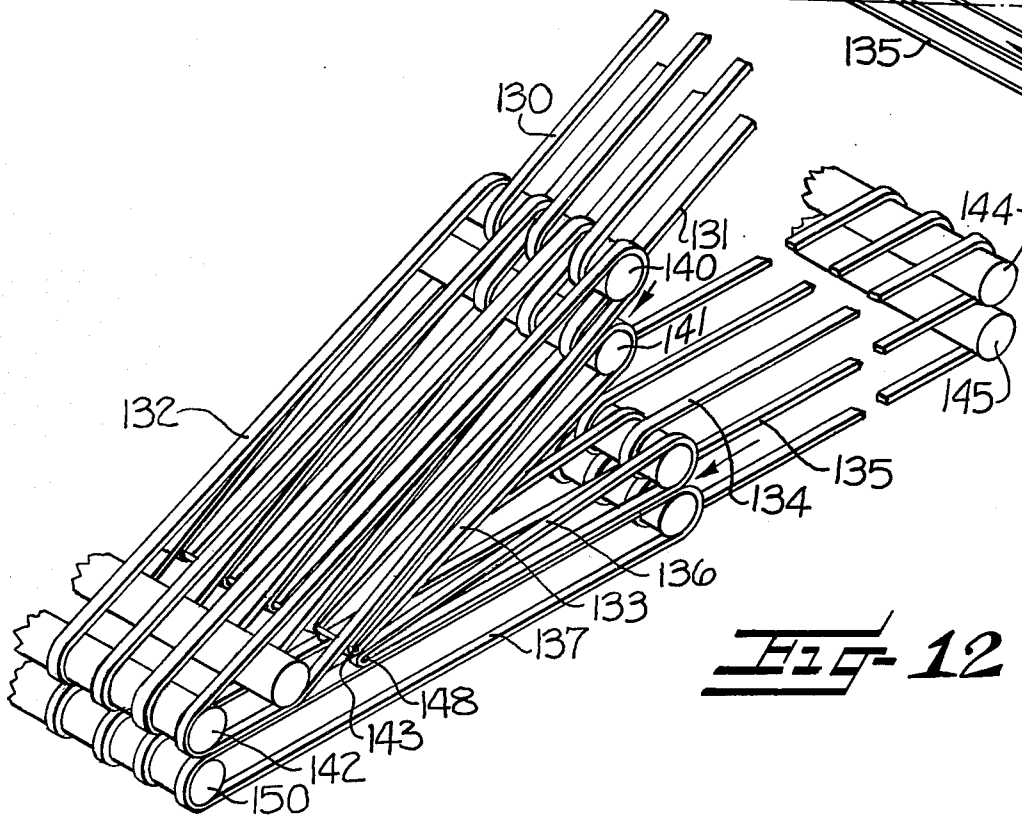
FIG. 12 is an enlarged perspective detail of a portion of the sideways Y-shaped conveyor means utilized in the other transverse partition strip fabricating station.

Referring now to the transverse partition strip fabricating stations B, B' (see FIGS. 11–13), the fabricated transverse partition strips T are fed from the reject conveyor mechanisms 100, 101 of each of the two above-described fabricating means at each fabricating station B, B' into conveyor means, broadly indicated at 120, of a generally sideways Y-shaped configuration for receiving the fabricated transverse partition strips T from their superimposed paths of travel and for alternately merging the fabricated transverse partition strips T into a single linear path of travel (see FIGS. 1 and 2). These generally sideways Y-shaped configuration conveyor means 120 for each of the transverse partition strip fabricating stations B, B' are constructed generally the same except that the conveyor means 120 for the station B' is generally upside down with respect to the conveyor means 120 for the station B. However, like reference numerals will be applied to each.

These generally sideways Y-shaped configuration conveyor means 120 each first include superimposed conveyors 122, 123. These conveyor mechanisms 122, 123 may also comprise a plurality of belts mounted on suitable driven rolls or pulleys 124, 125 which are also driven in synchronism with the other mechanisms of the partition strip fabricating stations (as shown schematically in FIG. 13).

Further, the sideways Y-shaped conveyor mechanisms 120 each comprise superimposed sets of transversely spaced-apart belts 130, 131, 132, 133, 134, 135, 136, 137 mounted on driven rolls or pulleys 138, 139, 140, 141, 142, 143, 144, 145, 146, 147, 148, 149, 150 and positioned in a generally sideways Y-shaped configuration for forming an upper leg and a lower leg which merge together and form a third leg for respectively receiving the cut transverse partition strips T, from their superimposed linear paths of travel through the two above-described partition strip fabricating means, between the sets of belts forming the respective upper and lower legs and for feeding the strips forwardly to the third leg. As may be seen in FIGS. 11–13, the sets of belts 130, 131, 132, 133 form the upper leg, the sets of belts 134, 135, 136, 137 form the lower leg and a portion of the sets of belts 132, 137 form the third leg. The lower set of belts 133 forming part of the upper leg and the upper set of belts 136 forming a part of the lower leg terminate at the third leg and the upper set of belts 132 forming part of the upper leg and the lower set of belts 137 forming part of the lower leg continue to form the third leg so that the transverse partition strips T being fed between the sets of belts forming the upper and lower legs merge into a single path of travel between the sets of belts forming the third leg for being fed forwardly toward the assembling stations A, A'. The rolls or pulleys 138–150 are driven in synchronism with the remaining mechanisms of the transverse partition strip fabricating station, as indicated schematically in FIGS. 11 and 13.

From the sideways Y-shaped conveyors 120, each of the cut and slotted transverse partition strips T are fed into a positioning mechanism 160 for suitably positioning the transverse partition strips T in the partition assembling stations A, A'. This positioning mechanism 160 will be described below in connection with a description of the partition assembling stations.

II. Partition Assembling Stations

Each of the partition assembling stations A, A'successively receive the leading cut and slotted edges of the transverse and longitudinal partition strips T and L on respective opposite sides, successively position the transverse partition strips T with successive flaps of each in vertically staggered and spaced positions, successively position the longitudinal partition strips L in successive vertically-staggered and spaced relationship with all of the flaps of each strip in one vertical plane, convey the thus positioned partition strips T, L in a longitudinal direction generally transversely of the path of travel through the fabricating stations B, B' and C, C' at a converging predetermined angle while separating a predetermined number of the strips T, L into opposing groups of longitudinally-staggered strips T, L and aligning the slots S of the strips T, L of opposing groups so that the opposing groups of strips T, L will converge and intermesh as they are fed in the longitudinal path of travel for assembling the partitions P in a collapsed condition (see FIGS. 1, 2 and 17–22).

As mentioned above, the assembling stations A, A' are constructed generally in accordance with copending applications Ser. Nos. 855,711, 855,622 and 855,713 of the assignee of the present invention and these assembling stations are only broadly illustrated and described herein and reference may be had to these copending applications for a full disclosure and description of these assembling stations.

Figure 17:
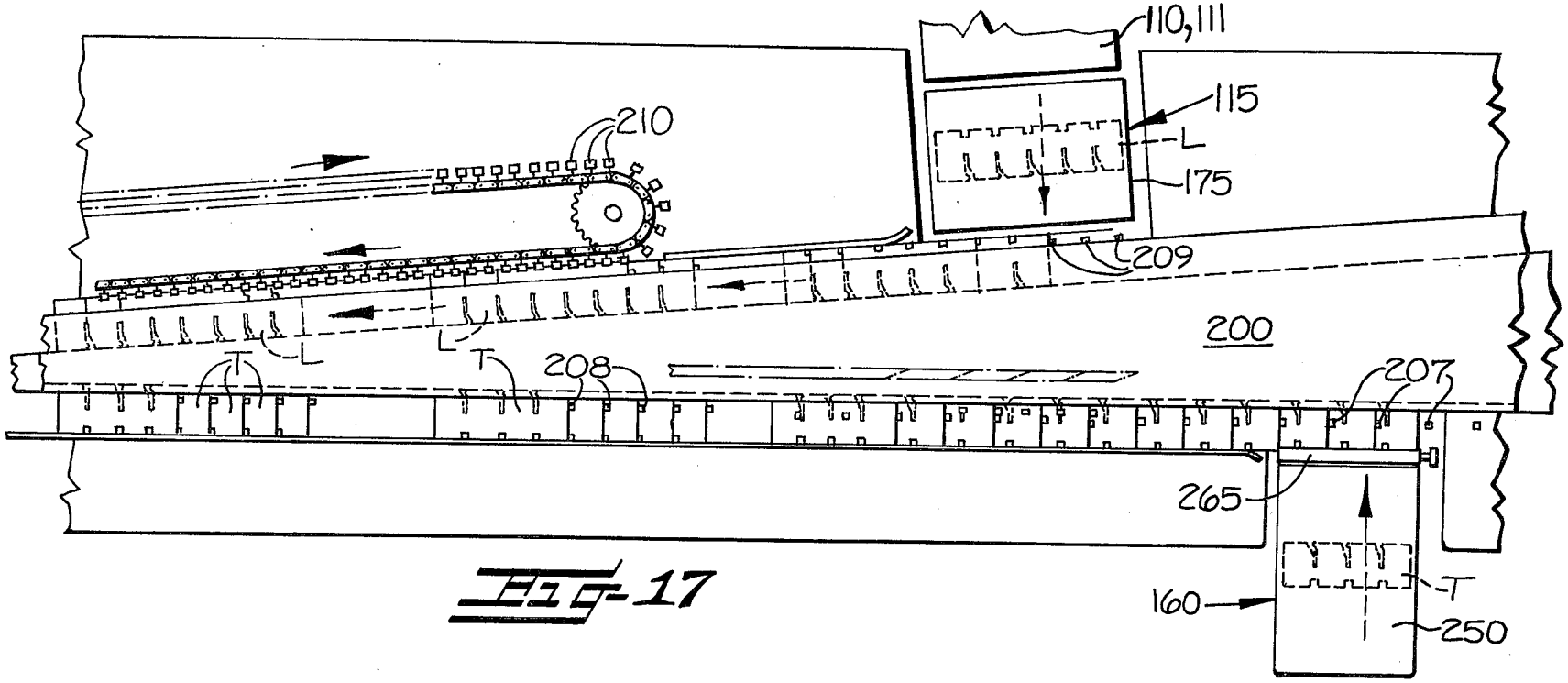
FIG. 17 is a plan view of the rear portion of one of the assembling stations of the apparatus of FIG. 1.
Figure 18:
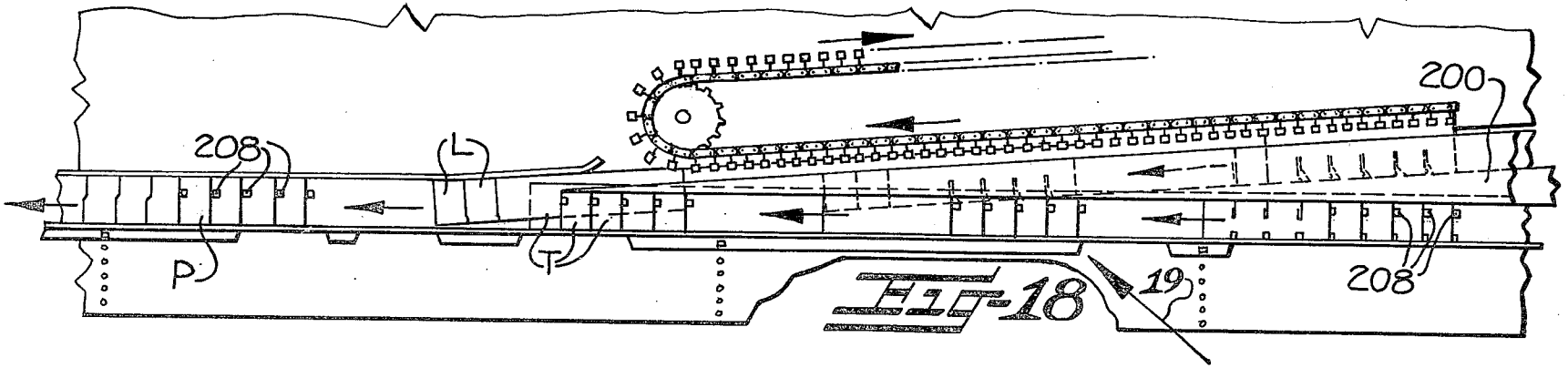
FIG. 18 is a continuation of the plan view of FIG. 17 illustrating a forward portion of the assembling station.

Broadly, each of the partition assembling stations include an elongate horizontally-extending guide 200 defining a plurality of longitudinally and horizontally-extending spaced parallel trackways 202 and 204 in respective opposite sides thereof for respectively receiving the leading slotted edges of the transverse and longitudinal partition strips T, L therein at a receiving or rearward end thereof (as viewed in FIGS. 1 and 17). These trackways 202, 204 correspond in number and position to the desired intermeshing relationship of the longitudinal and transverse partition strips when assembled into a partition in collapsed intermeshing relationship and to the desired number of such strips for the varying cell types of partitions, e.g. twelve,, twenty-four, etc., to be assembled by the apparatus of this invention.

Elongate cams 206 are movably positioned within the trackways 204 so that the openings in these trackways extend inwardly from the opposite outer edge of the guide 200 at a converging intermeshing predetermined angle from the end of the guide 200 receiving the partition strips to the other end thereof with respect to the trackway openings 202.

Means, in the form of chain mounted conveyor dogs 207, 208 and 209 and gripper devices 210, continuously feed the transverse and longitudinal strips T, L along the cams 206 and within the trackway 202, 204 from the receiving end to the remote end of the guide 200 for converging and intermeshing the slotted partition strips T, L for assembling partitions P in a collapsed condition (as indicated schematically in FIGS. 17, 18, 20, 21 and 22).

Figure 23:
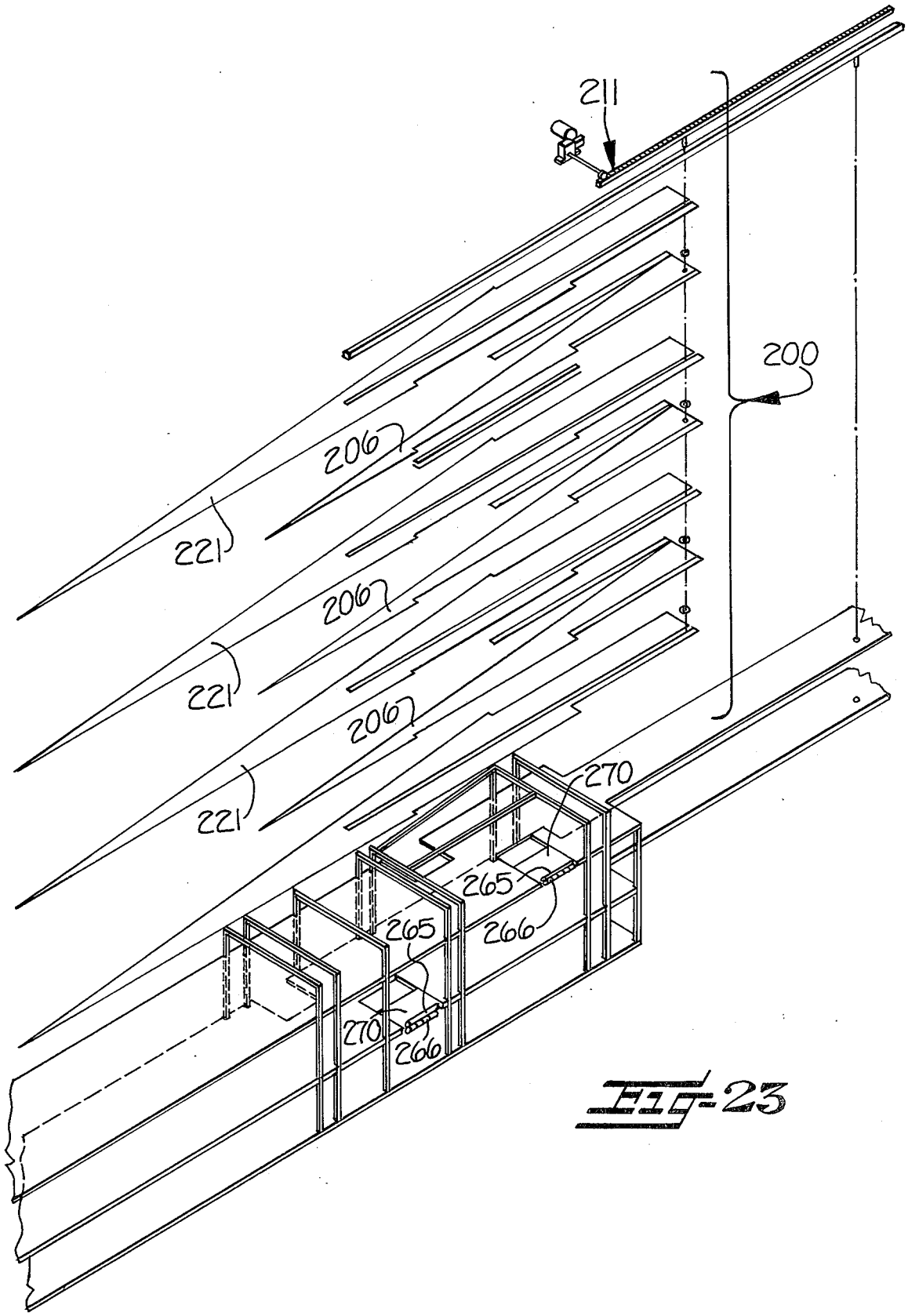
FIG. 23 is an exploded fragmentary perspective view of the partition assembling guide means and related elongate cam means of one of the partition assembling stations of the apparatus of FIG. 1.

Adjustment devices indicated broadly at 211 in FIG. 23 are provided for the cams 206 for longitudinally moving the cams 206 within the guide 200 for varying the longitudinal position thereof and thus the depth of the trackway openings 204 along the guide 200 for assembling various sizes and types of partitions P.

Figure 20:
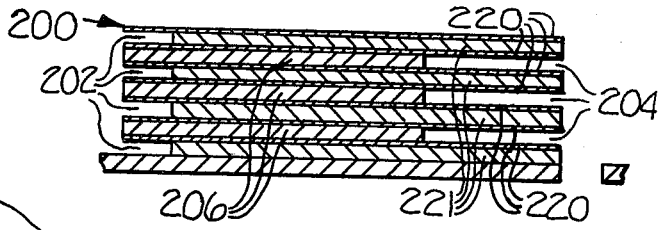
FIG. 20 is an enlarged cross-sectional view, taken generally along the line 20—20 of FIG. 19.
Figure 19:
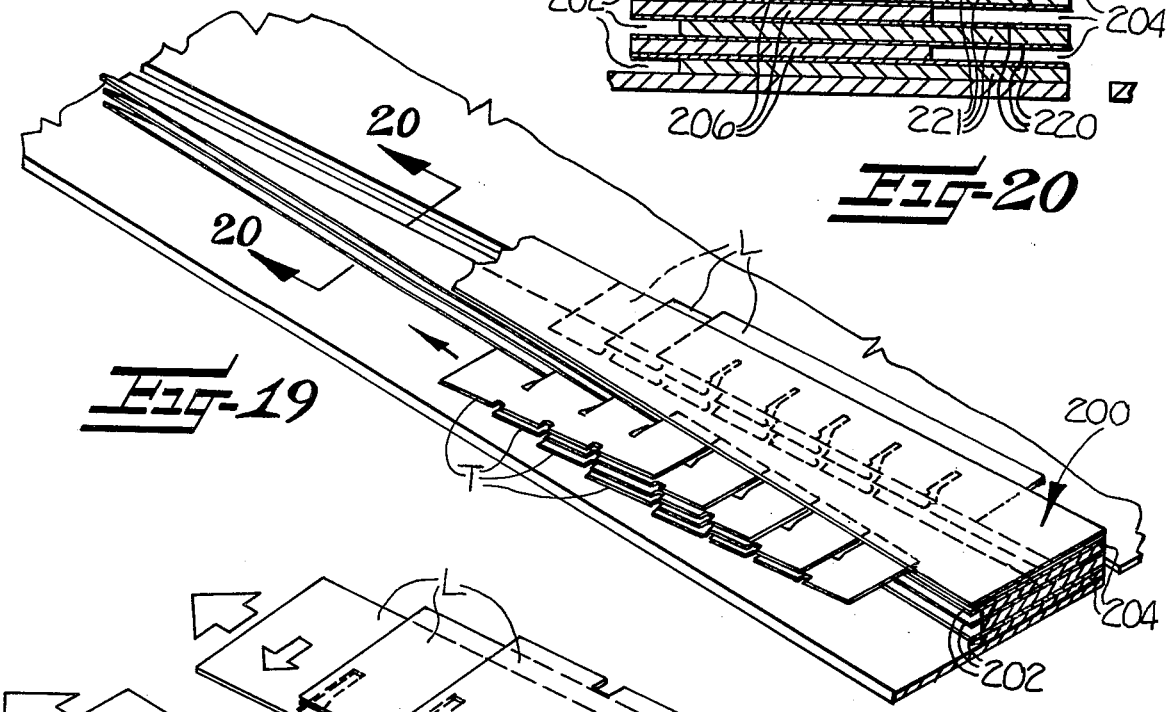
FIG. 19 is an enlarged perspective detail of a portion of the guide means of one of the partition assembling stations of the apparatus of FIG. 1, looking generally in the direction of the arrow 19 in FIG. 18, and showing a cooperating pair of groups of transverse and longitudinal partition strips as they are being fed along the guide means.
Figure 21:
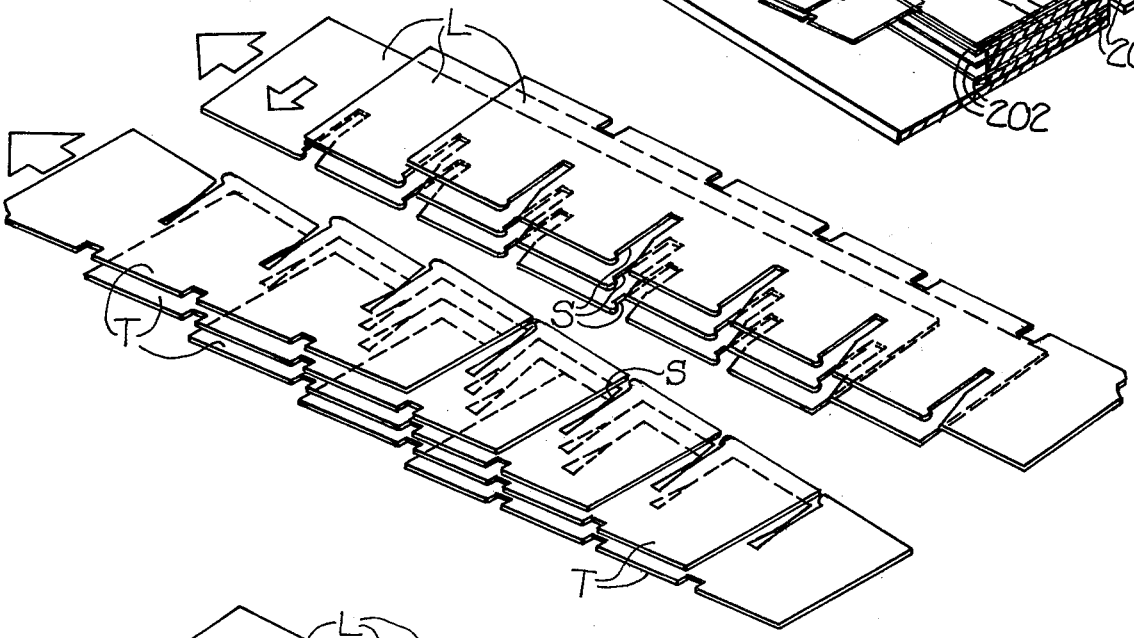
FIG. 21 is an enlarged perspective view illustrating the condition of the two groups of the transverse and longitudinal partition strips in FIG. 19, but showing the same removed from the guide means for purposes of clarity, as they are being fed along the guide means of the assembling station.
Figure 22:
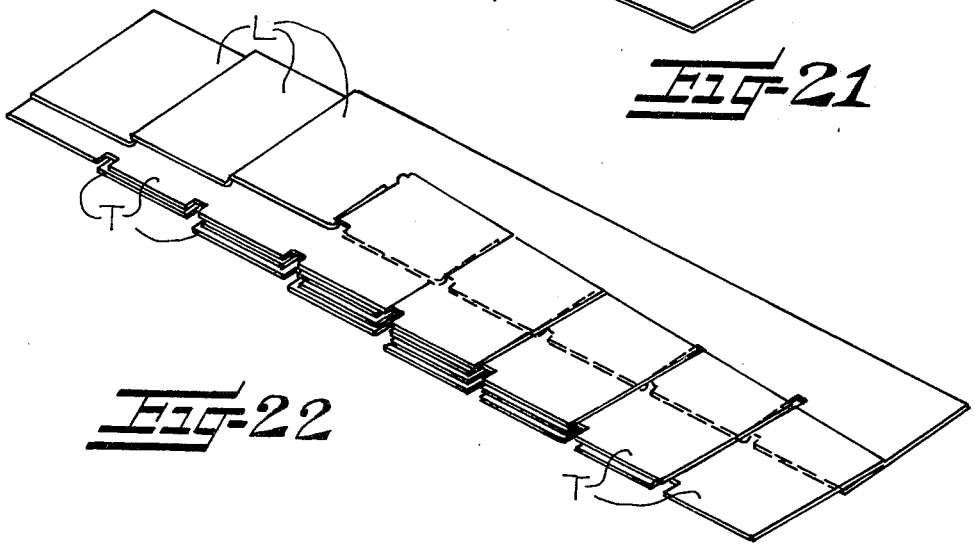
FIG. 22 is a view, like FIG. 21, illustrating the condition of the groups of transverse and longitudinal strips as they are fed more forwardly along the guide means and substantially into intermeshing assembled relationship.

As may be seen particularly in FIG. 20, the guide 200 comprises a plurality of superimposed plates 220 having stationary plates 221 between every other pair of plates 220 which terminate short of the outside edges of the plates 220 to define trackway openings or stationary depth grooves 202 on one side of the guide 200 and having the movable cams 206 positioned between the alternating pairs of plates 220 to form the trackway openings or variable depth slots 24 on the other side. Toward the remote end of the guide 200 (see FIG. 18), the trackway grooves 202 and slots 204 converge such that the leading ends of the transverse and longitudinal partition strips T, L may overlap and intermesh with each other for completing the assembly of a partition P.

Figure 16:
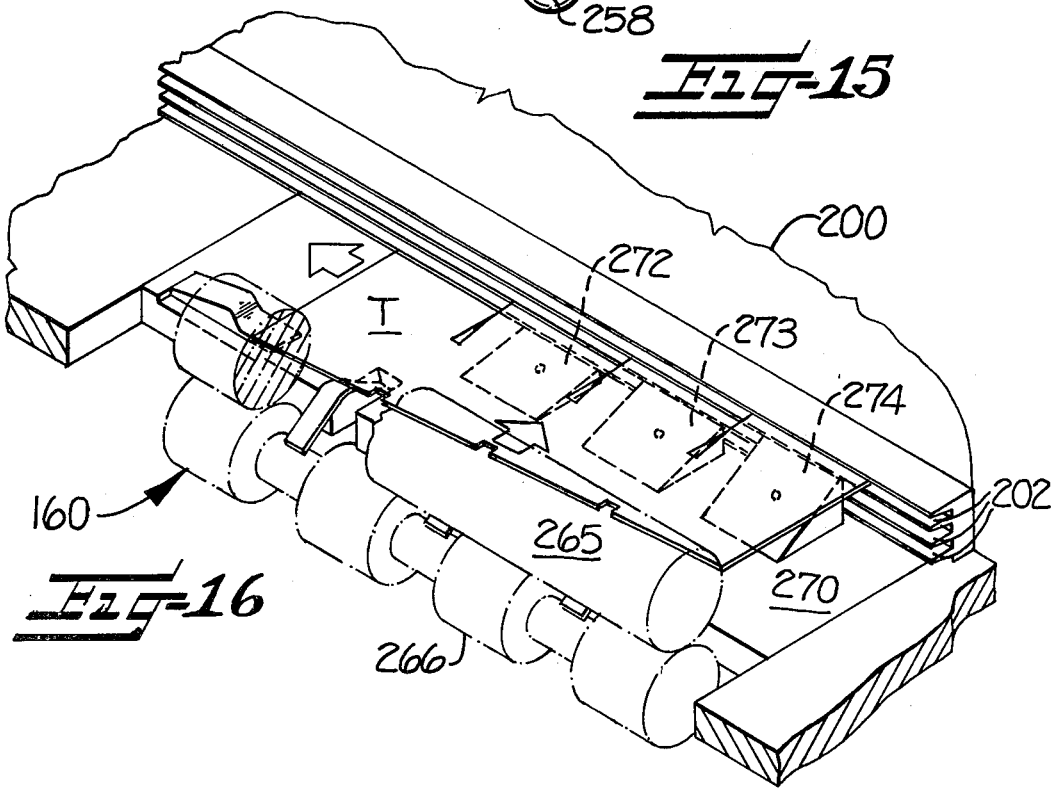
FIG. 16 is a perspective detail of the mechanism for positioning transverse partition strips into the partition assembling station.

Referring now to FIGS. 11, 13 and 16, the means 160 for receiving the fabricated transverse partition strips T and for conveying the strips T with the slotted leading edge toward the trackway grooves 202 in the guide 200 comprises a pair of superimposed conveyor mechanisms 250, 251 and 251' which may comprise a plurality of spaced-apart belts suitably mounted on and rotated by driven feed rolls 252–261 which are suitably driven in synchronism with other portions of the partition strip fabricating stations B, B' (as indicated schematically in FIGS. 11 and 13). The partition strips T are fed from between the superimposed conveyors 250, 251 and 251' into the nip of a pair of superimposed driven feed rolls 265, 266 which feed the transverse partition strips T toward the trackway grooves 202 of the guide 200. As may be seen in FIG. 16, receiving and positioning surface means 270 extend outwardly from the lowermost trackway groove 202 for receiving the leading slotted edge of the fabricated partition strip T thereon and for guiding the forward flap of the strip T into the lowermost trackway opening 202. There is further provided rearwardly spaced successively higher ramp means 272, 273, 274 on the surface means 270 positioned for receiving the successive rearwardly-extending flaps of the partition strip T and positioning the flaps successively into successive vertically-spaced trackway grooves 202 in the guide 200, as shown in FIG. 16. Also, the upper roll 265 of the pair of rolls 265, 266 is positioned slightly forwardly of the lower roll 266 for deflecting the leading slotted edge and the flaps of the transverse partition strip T in a generally downward direction toward the positioning surface 270 to maintain the flaps of the partition strip T in engagement with the positioning surface 270 and the ramps 272–274.

Figure 14:
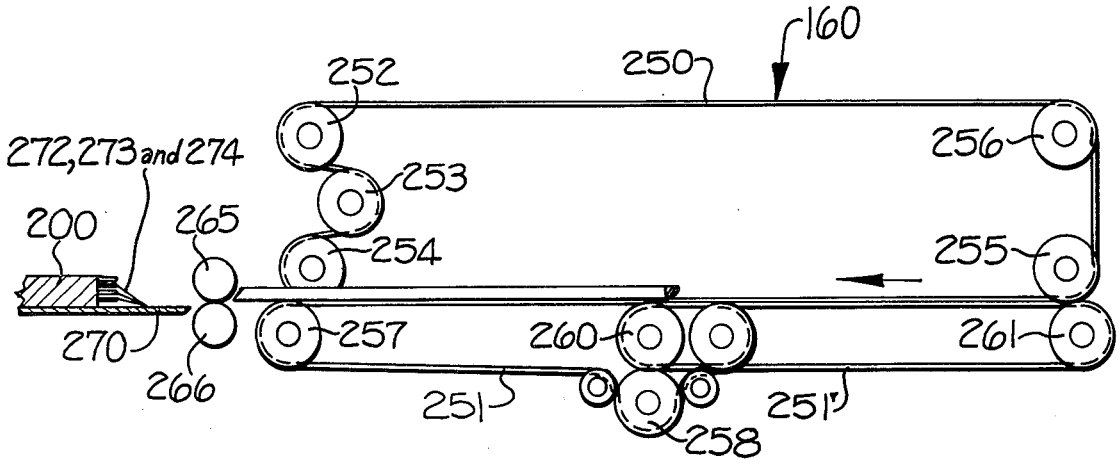
FIG. 14 is an enlarged schematic and diagrammatic elevational view of a portion of the conveyor mechanisms of either FIG. 11 or FIG. 13 just prior to feeding the transverse partition strips into the assembling station.
Figure 15:
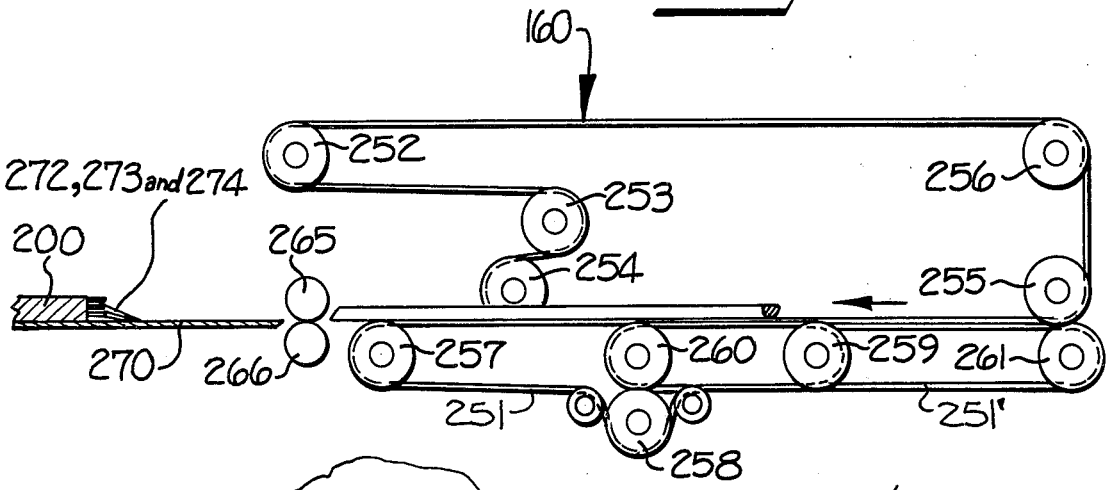
FIG. 15 is a view, like FIG. 14, illustrating the final feed rolls adjusted to a rearward position with corresponding adjustments of the conveyor belts for maintaining proper tension therein.

The transverse partition strip positioning means 160 also includes provisions for moving the feed rolls 265, 266 forwardly and rearwardly for different height partition strips which also requires corresponding movement of conveyor belts 250, 251 and rolls 253, 254, 257, 259, as shown in FIGS. 14 and 15, so as to maintain a distance between the exit of the conveyors 250, 251 and the entrance to the feed rolls 265, 266 equal to approximately the height of a partition strip T. Further details of the above-described mechanism may be had by reference to assignee's above-mentioned copending applications.

Referring now to FIGS. 8 and 17, the positioning means 115 for receiving the fabricated longitudinal partition strips L and for conveying the strips L with the slotted leading edge toward the trackway slots 204 in the guide 200 comprises a delivery mechanism in the form of superimposed conveyor mechanisms 175, 176 suitably mounted on driven rolls or pulleys 177, 178 which are carried by a carriage or frame 180 suitably mounted for oscillating up and downward movement of its forward end, as indicated by the arrows in FIG. 8. The carriage 180 includes a downwardly extending arm 181 having a cam follower 182 therein for engaging the inside surface of a driven adjustable cam 183 which is mounted for rotation for effecting desired adjustable upward and downward oscillating movement of the conveyors 175, 176. The cam 183 is so configured that the longitudinal partition strips L will be successively fed through the conveyors 175, 176 and the leading slotted end of each successive strip L with all of the flaps will be respectively successively positioned in each of the vertically spaced trackway slots 204 with all of the flaps of each strip in a respective slot so that the strips will be in vertically spaced position. As each longitudinal partition strip L is positioned within a respective trackway slot 204, one of the feed fingers 209 will engage the rear end thereof and feed the strip forwardly along the guide 200 to make room for reception of the next longitudinal partition strip L. Further details of the construction and operation of this positioning mechanism 115 may be had by reference to assignee's copending applications.

As the transverse and longitudinal partition strips T, L are fed forwardly along the guide 200 and out of the way of the positioning mechanisms 160, 115, the partition strips T, L will be grouped by the feed dogs 208, 209 into opposing groups of desired numbers of strips (as shown in the left hand side of FIG. 17) to be fed along the guide 200 within the trackway grooves and slots 202, 204 for assembling the partitions P in collapsed condition. Further details of the construction and operation of these assembling stations may be had by reference to assignee's above mentioned copending applications.

Figure 24:
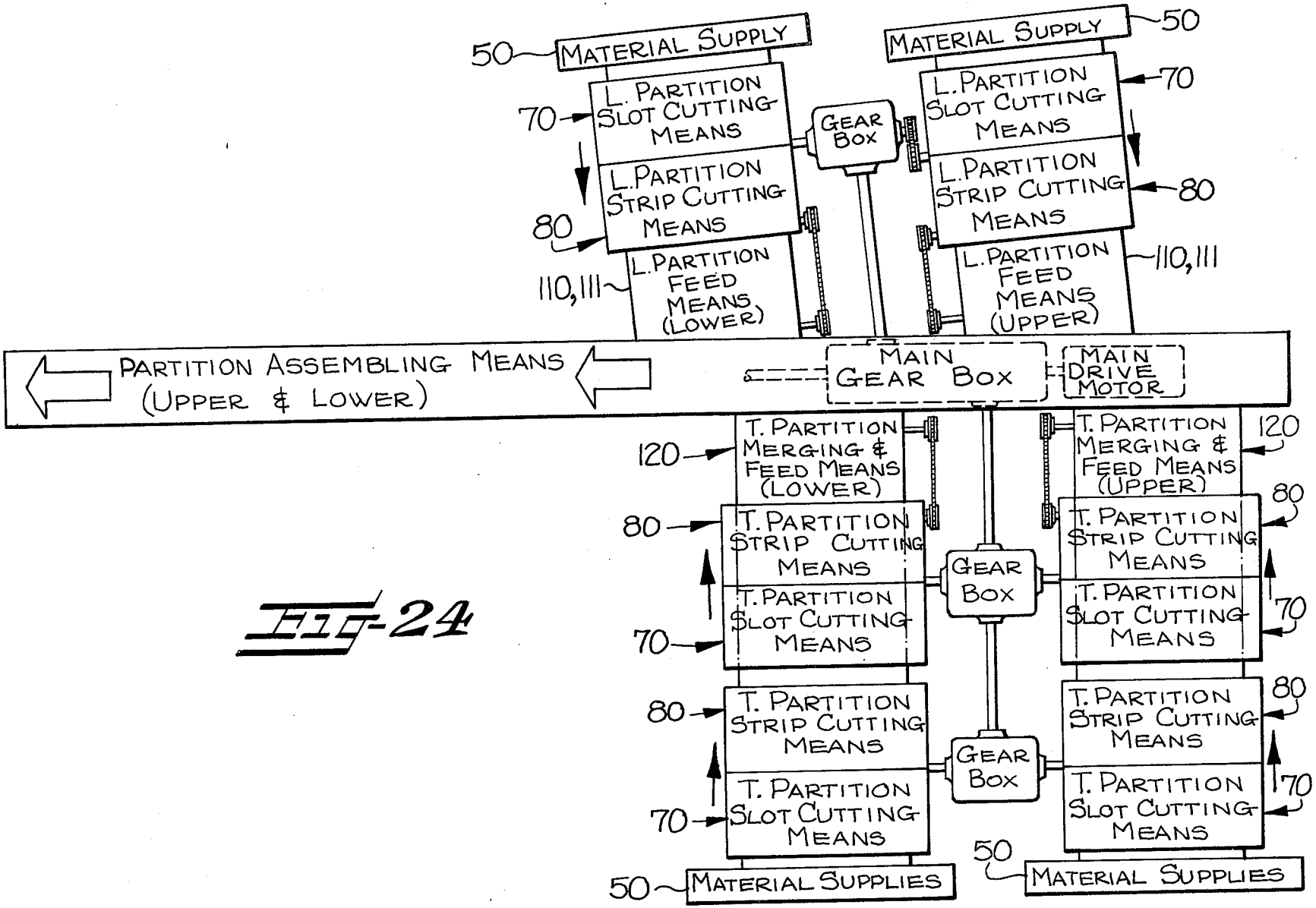
FIG. 24 is a schematic and diagrammatic view of the drive mechanisms for the apparatus of FIG. 1.

Referring to FIG. 24, there is shown schematically and diagrammatically therein a suitable interconnected drive arrangement for the apparatus of this invention. Inasmuch as this drive arrangement does not constitute a specific part of the present invention and any suitable drive may be used, further details thereof are not deemed necessary.

In the drawings and specification, there has been set forth a preferred embodiment of the invention, and although specific terms are employed, they are used in a generic and descriptive sense only and not for purposes of limitation.

What is claimed is:

1. Apparatus for successively fabricating and assembling in a collapsed condition multi-cell partitions having a plurality of intermeshing, slotted, transverse and longitudinal strips for use in cartons, crates and the like, said apparatus being characterized by an improved construction providing for fabrication and assembly of varying sizes and types of partitions at desired speeds for commercial operation, said apparatus comprising:

separate adjustable means for fabricating elongate transverse and longitudinal partition strips from a continuous length of material, of a width desirable for the length of the strips, into individual strips of adjustable desired height having a desired adjustable number of spaced-apart slots in each extending inwardly a desired adjustable distance from a leading edge thereof to define a desired number of flaps on the leading end and for feeding such strips in a generally horizontally-extending linear path of travel;

the separate means for fabricating transverse partition strips comprising two of said fabricating means positioned for feeding the respective cut and slotted transverse strips in generally superimposed horizontally-extending linear paths of travel, and conveyor means of a generally sideways Y-shaped configuration for receiving the fabricated partition strips from their superimposed paths of travel and for alternately merging the fabricated transverse partition strips into a single linear path of travel;

the separate means for fabricating longitudinal partition strips comprising a single one of said fabricating means positioned for feeding the respective cut and slotted longitudinal partition strips in the generally horizontal linear path of travel in an opposing direction to the feed of the transverse partition strips; and partition assembling means for successively receiving the leading cut and slotted edges of the transverse and longitudinal partition strips on respective opposite sides, for successively positioning strips of one of the series of fabricated transverse and longitudinal strips with successive flaps of each in vertically staggered and spaced positions, for successively positioning strips of the other of the series of fabricated transverse and longitudinal strips in successive vertically-staggered and spaced relationship with all of the flaps of each strip in one vertical plane, for conveying the thus positioned strips in a longitudinal direction generally transversely of the path of travel thereof through said fabricating means at a converging predetermined angle while separating a predetermined number of the strips into opposing groups of longitudinally-staggered strips and aligning the slots of the strips of opposing groups so that the opposing groups of strips will converge and intermesh as they are fed in the longitudinal path of travel for assembling the partitions in a collapsed condition.

2. Apparatus, as set forth in claim 1, in which said transverse partition strip fabricating means comprises two pairs of said fabricating means positioned side-by-side on one side of said assembling means;

said longitudinal partition strip fabricating means compises two fabricating means positioned side-by-side on the other side of said assembling means; and said partition assembling means comprises two longitudinally-extending parallel superimposed assembling means for respectively receiving and assembling longitudinal and transverse partition strips from one of said two pairs of transverse partition strip fabricating means and from one of said two longitudinal partition strip fabricating means.

3. Apparatus, as set forth in claim 1, in which said separate adjustable means for continuously fabricating elongate transverse and longitudinal partition strips each comprises means for supplying a length of material of a width desirable for the length of the partition strips, means for successively cutting longitudinally spaced-apart rows of slots extending transversely across the length of material, means for successively transversely cutting the length of material into individual partition strips of desired height along and through the slots cut therein so that the slots extend inwardly a desired distance from the leading cut edge of the partition strips, means for feeding the material through said slot cutting means and said strip cutting means, and adjustable means operatively associated with said slot cutting means, said strip cutting means and said feeding means for being adjusted to vary the height of the partition strips cut by said strip cutting means while insuring proper placement of the slots cut by said slot cutting means.

4. Apparatus, as set forth in claim 3, in which said separate adjustable means for continuously fabricating elongate transverse and longitudinal partition strips each further comprise rotatably driven superimposed conveyor means positioned adjacent said strip cutting means for receiving the cut partition strips from said strip cutting means therebetween and for feeding the strips forwardly in the generally horizontally-extending linear path of travel, and driven eccentric cam means separately mounting said last mentioned conveyor means for timed generally vertical movement toward and away from each other for intermittent feeding of the cut strips in desired spaced-apart relation toward said partition assembling means.

5. Apparatus, as set forth in claim 4, in which said separate adjustable means for continuously fabricating elongate transverse and longitudinal partition strips each further comprise rotatably driven conveyor means positioned in the generally horizontally-extending linear path of travel of the cut partition strips adjacent said intermittent feed conveyor means for receiving and feeding the cut strips forwardly in their path of travel, and means pivotally mounting said last mentioned conveyor means for desired operation to move a forward end of said conveyor means out of the normal path of travel of the partition strips to reject certain fabricated partition strips from said fabricating means in the event of improper fabrication or the like.

6. Apparatus, as set forth in claim 1, in which said sideways Y-shaped conveyor means of said transverse partition strip fabricating means comprises superimposed sets of transversely spaced-apart belts mounted on driven roll means and positioned in a generally sideways Y-shaped configuration forming an upper leg and a lower leg which merge together and form a third leg for respectively receiving the cut partition strips from the superimposed paths of travel of said two fabricating means between said sets of belts forming said respective upper and lower legs and feeding the strips forwardly to said third leg, said lower set of belts forming said upper leg and said upper set of belts forming said lower leg terminating at said third leg and said upper set of belts forming said upper leg and said lower set of belts forming said lower leg continuing to form said third leg so that the strips being fed from between said sets of belts forming said upper and lower legs merge into a single path of travel between said sets of belts forming said third leg for being fed forwardly toward said assembling means.

7. Apparatus, as set forth in claim 1, in which said partition assembling means includes an elongate horizontally-extending guide means defining a plurality of longitudinally and horizontally-extending spaced parallel grooved trackways in respective opposite sides thereof for respectively receiving the leading slotted edges of the transverse and longitudinal partition strips therein at a receiving end thereof, said trackways corresponding in number and position to the desired intermeshing relationship of the longitudinal and transverse partition strips when assembled into a partition in collapsed intermeshing relationship, elongate cam means movably positioned interiorly within certain of said trackways of said guide means so that the grooves in said trackways extend inwardly from the opposite outer edges of said guide means at a converging intermeshing predetermined angle from the end of said guide means receiving the partition strips to the other end thereof, means for continuously feeding the transverse and longitudinal strips along said cam means and within said trackways from the receiving end to the remote end of said guide means for converging and intermeshing the slotted partition strips for assembling partitions in collapsed condition, and adjustment means for said cam means for longitudinally moving said cam means within said guide means for varying the longitudinal position thereof and thus the depth of said trackways along said guide means for assembling various sizes and types of partitions.

8. Apparatus, as set forth in claim 7, in which said grooved trackways in said respective opposite sides of said guide means comprises a plurality of longitudinally and horizontally-extending vertically-spaced parallel trackway openings in one side thereof extending a predetermined distance inwardly of said guide means, and a plurality of longitudinally and horizontally-extending spaced trackway slots in the other side of said guide means extending therethrough to the one side thereof in parallel alternating vertically-staggered intermeshing relationship to said trackway openings, said elongate cam means being positioned interiorly within said trackway slots for defining open portions in said trackway slots extending inwardly from the other side of said guide means at a converging intermeshing predetermined angle to said trackway openings from said receiving end to said remote end of said guide means, and said assembling means further including means for successively positioning transverse strips with successive flaps thereof in two seccessive vertically spaced trackway openings at said receiving end of said guide means, and means for successively positioning longitudinal strips with all of the flaps thereof in two successive vertically-spaced trackway slots at said receiving end of said guide means.

9. Apparatus, as set forth in claim 8, in which said means for positioning said transverse strips with successive flaps thereof in the successive vertically spaced trackway openings at said receiving end of said guide means comprises conveying means for receiving the fabricated partition strips from said fabricating means and for conveying the strips with the slotted leading edge toward said trackway openings of said guide means, and receiving and positioning surface means extending outwardly from said lowermost trackway opening in said guide means for receiving the leading slotted edge of the fabricated partition strip thereon and for guiding the forward flap of the strip into the lowermost trackway opening and having rearwardly spaced successively higher ramp means thereon positioned for receivig the successive rearwardly-extending flaps of the partition strips and positioning the flaps successively into successive vertically spaced trackway openings of said guide means.

10. Apparatus, as set forth in claim 9, in which said conveying means of said transverse strip positioning means comprises a pair of driven roll means extending generally longitudinally of said guide means and transversely of the path of travel of the partition strips through said partition strip fabricating means for receiving the fabricated partition strips therebetween and conveying the partition strips onto said positioning surface of said ramp means thereof, the upper row of said pair of rows being positioned slightly forward of said lower row of said pair of rows for deflecting the leading slotted edge and the flaps of the fabricated partition strips in a generally downward direction toward said positioning surface to maintain the flaps of the partition strip in engagement with said positioning surface means and said ramp means thereof, and means mounting said roll means for adjustable movement toward and away from said trackway openings of said guide means for accommodating different heights of partition strips when varying sizes and types of partition strips are being fabricated and assembled.

11. Apparatus, as set forth in claim 8, in which said means for successively positioning longitudinal strips with all of the flaps thereof into successive vertically-spaced trackway slots at said receiving end of said guide means comprises conveying means for receiving the fabricated partition strips from said fabricating means and for conveying the strips with the slotted leading edge toward said trackway slots of said guide means, carriage means mounting said conveying means for pivotal vertical movement thereof for alignment thereof with each of said vertically-spaced trackway slots in said guide means for successively conveying the strips with all of the flaps thereof into successive vertically-spaced trackway slots at said receiving end of said guide means, and driven adjustable cam means connected with said carriage means for successively vertically pivoting said carriage means for successively positioning said conveying means for desired positioning of the strips in said trackway slots of said guide means in accordance with the type of partition to be assembled.

12. Apparatus for successively fabricating and assembling multi-cell partitions having a plurality of intermeshing slotted transverse and longitudinal strips for use in cartons, crates and the like, said apparatus being characterized by an improved construction providing for fabrication and assembly of varying sizes and types of partitions at desired speeds for commercial operation, said apparatus comprising:

separate means for fabricating the transverse and longitudinal partition strips each of which includes means for supplying a length of material of a width desirable for the length of the partition strips, means for successively cutting longitudinally spaced-apart rows of slots extending transversely across the length of the material, means for successively transversely cutting the length of material into individual partition strips of desired height along and through the slots cut therein so that the slots extend inwardly a desired distance from the leading cut edge of the partition strips, means for feeding the material through said slot cutting means and said strip cutting means, adjustable means operatively associated with said slot cutting means, said strip cutting means and said material feeding means for being adjusted to vary the height of the partition strips cut by said strip cutting means while insuring proper placement of the slots cut by said slot cutting means, and means for feeding the respective cut and slotted strips in a generally horizontal, linear path of travel;

said respective fabricating means for the transverse and longitudinal partition strips being positioned for fabricating and feeding the supply of material and respective cut and slotted strips in generally opposing, horizontal, linear paths of travel; and partition assembly means including an elongate horizontally-extending guide means defining a plurality of longitudinally and horizontally-extending spaced parallel grooved trackways in respective opposite sides thereof for respectively receiving the leading slotted edges of the transverse and longitudinal partition strips therein at a receiving end thereof, said trackways corresponding in number and position to the desired intermeshing relationship of the longitudinal and transverse partition strips when assembled into a partition in collapsed intermeshing relationship, elongate cam means movably positioned interiorly within certain of said trackways of said guide means so that the grooves in said trackways extend inwardly from the opposite outer edges of said guide means at a converging intermeshing predetermined angle from the end of said guide means receiving the partition strips to the other end thereof, means for continuously feeding the tranverse and longitudinal strips along said cam means and within said trackways from the receiving end to the remote end of said guide means for converging and intermeshing the slotted partition strips for assembling partitions in collapsed condition, and adjustment means for said cam means for longitudinally moving said cam means within said guide means for varying the longitudinal position thereof and thus the depth of said trackways along said guide means for assembling various sizes and types of partitions.

13. Apparatus, as set forth in claim 12, in which said transverse and longitudinal strip fabricating means comprise a pair of longitudinally extending parallel transverse partition strip fabricating means positioned on one side of said guide means of said partition assembling means, and a pair of longitudinally extending parallel longitudinal strip fabricating means positioned on the other side of said guide means of said partition assembling means, and said partition assembling means comprising a pair of longitudinally extending parallel superimposed assembling means for respectively receiving and assembling longitudinal and transverse partition strips from one of each of said transverse and longitudinal partition strip fabricating means.

14. Apparatus, as set forth in claim 12, in which the separate means for fabricating transverse partition strips comprises two of said fabricating means positioned for feeding the respective cut and slotted transverse strips in generally superimposed horizontally-extending linear paths of travel, and conveyor means of a generally sideways Y-shaped configuration for receiving the fabricated partition strips from their superimposed paths of travel and for alternately merging the fabricated transverse partition strips into a single linear path of travel, and the separate means for fabricating longitudinal partition strips comprising a single one of said fabricating means positioned for feeding the respective cut and slotted longitudinal partition strip in the generally horizontal linear path of travel in an opposing direction to the feed of the transverse partition strips.

15. Apparatus, as set forth in claim 12, in which said separate adjustable means for continuously fabricating elongate transverse and longitudinal partition strips each further comprise rotatably driven superimposed conveyor means positioned adjacent said strip cutting means for receiving the cut partition strips from said strip cutting means therebetween and for feeding the strips forwardly in the generally horizontally-extending linear path of travel, and driven eccentric cam means separately mounting said last mentioned conveyor means for timed generally vertical movement toward and away from each other for intermittent feeding of the cut strips in desired spaced-apart relation toward said partition assembling means.

16. Apparatus, as set forth in claim 15, in which said separate adjustable means for continuously fabricating elongate transverse and longitudinal partition strips each further comprise rotatably driven conveyor means positioned in the generally horizontally-extending linear path of travel of the cut partition strips adjacent said intermittent feed conveyor means for receiving and feeding the cut strips forwardly in their path of travel, and means pivotally mounting said last mentioned conveyor means for desired operation to move a forward end of said conveyor means out of the normal path of travel of the partition strips to reject certain fabricated partition strips from said fabricating means in the event of improper fabrication or the like.

17. Apparatus, as set forth in claim 14, in which said sideways Y-shaped conveyor means of said transverse partition strip fabricating means comprises superimposed sets of transversely spaced-apart belts mounted on driven roll means and positioned in a generally sideways Y-shaped configuration forming an upper leg and a lower leg which merge together and form a third leg for respectively receiving the cut partition strips from the superimposed paths of travel of said two fabricating means between said sets of belts forming said respective upper and lower legs and feeding the strips forwardly to said third leg, said lower set of belts forming said upper leg and said upper set of belts forming said lower leg terminating at said third leg and said upper set of belts forming said upper leg and said lower set of belts forming said lower leg continuing to form said third leg so that the strips being fed from between said sets of belts forming said upper and lower legs merge into a single path of travel between said sets of belts forming said third leg for being fed forwardly toward said assembling means.

18. Apparatus, as set forth in claim 12, in which said grooved trackways in said respective opposite sides of said guide means comprises a plurality of longitudinally and horizontally-extending vertically-spaced parallel trackway openings in one side thereof extending a predetermined distance inwardly of said guide means, and a plurality of longitudinally and horizontally-extending spaced trackway slots in the other side of said guide means extending therethrough to the one side thereof in parallel alternating vertically-staggered intermeshing relationship to said trackway openings, said elongate cam means being positioned interiorly within said trackway slots for defining open portions in said trackway slots extending inwardly from the other side of said guide means at a converging intermeshing predetermined angle to said trackway openings from said receiving end to said remote end of said guide means, and said assembling means further including means for successively positioning transverse strips with successive flaps thereof in two successive vertically spaced trackway openings at said receiving end of said guide means, and means for successively positioning longitudinal strips with all of the flaps thereof in two successive vertically-spaced trackway slots at said receiving end of said guide means.

19. Apparatus, as set forth in claim 18, in which said means for positioning said transverse strips with successive flaps thereof in the successive vertically spaced trackway openings at said receiving end of said guide means comprises conveying means for receiving the fabricated partition strips from said fabricating means and for conveying the strips with the slotted leading edge toward said trackway openings of said guide means, and receiving and positioning surface means extending outwardly from said lowermost trackway opening in said guide means for receiving the leading slotted edge of the fabricated partition strip thereon and for guiding the forward flap of the strip into the lowermost trackway opening and having rearwardly spaced successively higher ramp means thereon positioned for receiving the successive rearwardly extending flaps of the partition strips and positioning the flaps successively into successive vertically spaced trackway openings of said guide means.

20. Apparatus, as set forth in claim 19, in which said conveying means of said transverse strip positioning means comprises a pair of driven roll means extending generally longitudinally of said guide means and transversely of the path of travel of the partition strips through said partition strip fabricating means for receiving the fabricated partition strips therebetween and conveying the partition strips onto said positioning surface of said ramp means thereof, the upper row of said pair of rows being positioned slightly forward of said lower row of said pair of rows for deflecting the leading slotted edge and the flaps of the fabricated partition strips in a generally downward direction toward said positioning surface to maintain the flaps of the partition strip in engagement with said positioning surface means and said ramp means thereof, and means mounting said roll means for adjustable movement toward and away from said trackway openings of said guide means for accommodating different heights of partition strips when varying sizes and types of partition strips are being fabricated and assembled.

21. Apparatus, as set forth in claim 18, in which said means for successively positioning longitudinal strips with all of the flaps thereof into successive vertically-spaced trackway slots at said receiving end of said guide means comprises conveying means for receiving the fabricated partition strips from said fabricating means and for conveying the strips with the slotted leading edge toward said trackway slots of said guide means, carriage means mounting said conveying means for pivotal vertical movement thereof for alignment thereof with each of said vertically spaced trackway slots in said guide means for successively conveying the strips with all of the flaps thereof into successive vertically spaced trackway slots at said receiving end of said guide means, and driven adjustable cam means connected with said carriage means for successively vertically pivoting said carriage means for successively positioning said conveying means for desired positioning of the strips in said trackway slots of said guide means in accordance with the type of partition to be assembled.

* * * * *